US009453358B2

(12) United States Patent
Meersschaert et al.

(10) Patent No.: US 9,453,358 B2
(45) Date of Patent: Sep. 27, 2016

(54) MULTIPLE LOCK SYSTEM FOR A LUGGAGE CASE

(75) Inventors: Reinhard Meersschaert, Merelbeke (BE); Diego Recchia, Palestrina (IT)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

(21) Appl. No.: 14/344,683

(22) PCT Filed: Sep. 13, 2012

(86) PCT No.: PCT/EP2012/067991

§ 371 (c)(1),
(2), (4) Date: Aug. 28, 2014

(87) PCT Pub. No.: WO2013/037912

PCT Pub. Date: Mar. 21, 2013

(65) Prior Publication Data

US 2015/0040622 A1 Feb. 12, 2015

Related U.S. Application Data

(60) Provisional application No. 61/533,937, filed on Sep. 13, 2011, provisional application No. 61/623,462, filed on Apr. 12, 2012.

(51) Int. Cl.

| | |
|---|---|
| ***E05B 65/52*** | (2006.01) |
| ***E05B 35/10*** | (2006.01) |
| ***A45C 13/10*** | (2006.01) |
| ***E05B 37/12*** | (2006.01) |

(Continued)

(52) U.S. Cl.

CPC ..... *E05B 65/52* (2013.01); *A45C 13/10* (2013.01); *A45C 13/103* (2013.01); *A45C 13/1023* (2013.01); *A45C 13/18* (2013.01); *E05B 35/105* (2013.01); *E05B 37/12* (2013.01); *E05B 37/0034* (2013.01); *E05B 37/0051* (2013.01); *Y10T 70/5058* (2015.04)

(58) Field of Classification Search

CPC .. A45C 13/103; A45C 13/18; A45C 7/0068; A45C 2005/037; E05B 65/52; E05B 67/02; E05B 65/50

USPC ..... 70/67, 68, 312, 284, 285

See application file for complete search history.

(56) References Cited

U.S. PATENT DOCUMENTS

| | | | |
|---|---|---|---|
| 5,557,954 | A | 9/1996 | Ling |
| 5,689,979 | A | 11/1997 | Yu |

(Continued)

FOREIGN PATENT DOCUMENTS

| | | | |
|---|---|---|---|
| AU | 2010201766 | A1 | 11/2010 |
| CN | 2154609 | Y | 2/1994 |

(Continued)

*Primary Examiner* — Suzanne Barrett

(74) *Attorney, Agent, or Firm* — Dorsey & Whitney LLP

(57) ABSTRACT

An apparatus for selectively securing at least a first zipper closure mechanism (25) and a second zipper closure mechanism (135) of a luggage case (100), may include a lock device (145) coupled to the luggage case (100). The lock device (14) includes a lock mechanism (158) operable between a locked and unlocked configuration, at least two securing recesses (151, 152, 153, 154) for releasable receipt of at least a portion of each of the respective first and second zipper closure mechanisms (125, 135), and at least one release member (160) for actuating the lock mechanism (158).

20 Claims, 28 Drawing Sheets

(51) Int. Cl.
*A45C 13/18* (2006.01)
*E05B 37/00* (2006.01)

(56) References Cited

U.S. PATENT DOCUMENTS

| | | | | |
|---|---|---|---|---|
| 6,568,225 | B1 * | 5/2003 | Chang | 70/69 |
| 6,807,832 | B1 | 10/2004 | Jeng | |
| 7,467,695 | B2 | 12/2008 | Gormick et al. | |
| 7,503,440 | B2 | 3/2009 | Gormick et al. | |
| 7,913,526 | B2 | 3/2011 | Loughlin et al. | |
| 8,661,861 | B2 * | 3/2014 | Lai | 70/21 |
| 9,101,186 | B2 * | 8/2015 | Lai | |
| 2002/0129628 | A1 * | 9/2002 | Skalberg | 70/18 |
| 2004/0237605 | A1 * | 12/2004 | Lin et al. | 70/68 |
| 2015/0014109 | A1 * | 1/2015 | Lai | 190/111 |

FOREIGN PATENT DOCUMENTS

| | | | |
|---|---|---|---|
| CN | 1175388 | A | 3/1998 |
| DE | 29820726 | U1 | 3/2000 |
| EP | 1510146 | A1 | 3/2005 |
| GB | 2319801 | A | 6/1998 |
| JP | 3017432 | U | 10/1995 |
| JP | 3114912 | U | 9/2005 |
| JP | 2005288065 | A | 10/2005 |
| WO | 99/55189 | A2 | 11/1999 |

* cited by examiner

MULTIPLE LOCK SYSTEM FOR A LUGGAGE CASE

CROSS-REFERENCE TO RELATED APPLICATIONS

This application is the national stage application of International Patent Application No. PCT/EP2012/067991 filed on Sep. 13, 2012 and entitled "Multiple Lock System For a Luggage Case" which claims the benefit of U.S. provisional application No. 61/533,937 entitled "Dual Zipper Lock System" filed on Sep. 13, 2011 and U.S. provisional application No. 61/623,462 entitled "Multiple Lock System for a Luggage Case" and filed on Apr. 12, 2012, which are hereby incorporated by reference in their respective entireties.

TECHNOLOGICAL FIELD

The technological field generally relates to luggage and bags and more particularly to multiple lock systems for luggage and bags.

BACKGROUND

Zippers are often provided on luggage or other bags to access and seal luggage compartments. Each zipper typically includes a zipper track disposed around at least a portion of a compartment, and at least one zipper slider with at least one zipper pull tab associated with the zipper track. Luggage users may in some cases wish to restrict access to a zippered compartment. To restrict access to a compartment enclosed by a zipper, a user may affix a lock to the luggage to secure the compartment. Various luggage locks have been developed to secure zippered compartments, such as a padlock that may be placed through apertures in zipper pull tabs or through hasps on zipper sliders, and mounted locks that secure a single zipper's pull tab(s) to the side of a luggage case. These locks may have an associated key and/or associated combination or code that, when used, allows the lock to be selectively opened by a user or other authorized person. Many of these locks, however, are only able to secure a single zippered compartment, whereas many luggage cases today have two or more zippered compartments. Should a user wish to secure two compartments, two or more different locks may be required.

The present disclosure advantageously provides multiple lock systems for luggage cases that may overcome the foregoing drawbacks. For example, the locking mechanisms described herein may selectively couple two or more zipper closure mechanisms via a single locking device. In this manner, for example, a single lock, potentially with a single key or a single combination, may be used to secure a plurality of compartments or pockets in a luggage case.

Documents that may be related to the present disclosure in that they include lock systems include: U.S. Pat. No. 6,807,832, U.S. Pat. No. 4,020,930, WO 2008/034006, U.S. Pat. No. 6,202,455, EP 1,510,146, FR 1,032,266, U.S. Pat. No. 4,756,171, U.S. Pat. No. 6,941,777, U.S. Pat. No. 5,156,028, and U.S. Pat. No. 7,631,524.

SUMMARY

In one embodiment, an apparatus for selectively securing at least a first zipper closure mechanism and a second zipper closure mechanism of a luggage case is provided. The apparatus may include a lock device coupled to the luggage case, which in turn includes a lock mechanism operable between a locked and unlocked configuration. The lock device may also include at least two securing recesses for releasable receipt of at least a portion of each of the respective first and second zipper closure mechanisms, and at least one release member for actuating the lock mechanism.

In some examples, the second zipper closure mechanism advantageously includes an elongated cable defining a free end, the elongated cable operably engageable with at least one zipper slider to limit its movement. At least one of the two securing recesses may be operable to releasably receive the free end of the cable. In some examples, at least one zipper slider is operably associated with a pocket compartment of a luggage case, and/or at least one zipper slider includes at least one hasp configured to selectively receive a portion of the elongated cable therethrough. At least one zipper pull-tab may be coupled to the at least one zipper slider, and the at least one zipper pull-tab includes an aperture configured to selectively receive a portion of the elongated cable therethrough.

The lock device includes a housing with a length defining a middle portion and opposing end portions. In some examples the lock mechanism is advantageously positioned along the middle portion of the lock housing. Some examples of the lock mechanism include combination dials. The securing recesses may be positioned on respective opposing end portions of the lock housing.

In another embodiment an apparatus for selectively securing at least a first zipper closure mechanism and a second zipper closure mechanism of a luggage case may include a lock device coupled to the luggage case. The lock device includes a lock mechanism operable between a locked and unlocked configuration, at least two securing recesses for releasable receipt of at least a portion of each of the respective first and second zipper closure mechanisms, and at least one release member for actuating the lock mechanism. The first zipper closure mechanism includes an elongated cable defining a free end, the elongated cable operable to engage at least one zipper slider and limit movement of the at least one zipper slider. A first of the least two securing recesses is operable to releasably receive the free end of the cable. Furthermore, the second zipper closure mechanism including at least a zipper slider and a zipper pull tab operably associated with the zipper slider, and the second of the at least two securing recesses is operable to releasably receive the zipper pull tab.

In one example, the lock mechanism is a first lock mechanism, the first lock mechanism includes combination dials, and the lock device further includes a second lock mechanism, a tumbler lock. In another example, the zipper slider is a first zipper slider, the zipper pull tab is a first zipper pull tab, and the second zipper closure mechanism further includes a second zipper slider, and the lock device further includes a third securing recess for releasable receipt of the second zipper pull tab. In still another example, the second zipper closure mechanism at least partially encloses a compartment of the luggage case, and the first and second zipper sliders are operable to selectively hinder access to the compartment.

In another embodiment, an apparatus selectively secures at least one zipper closure mechanism of a luggage case. The apparatus may include a lock device coupled to the luggage case, and the lock device may include a lock mechanism operable between a locked and unlocked configuration. At least one securing recess releasably receives at least a portion of the at least one zipper closure mechanism, and at least one release member actuates the lock mechanism. The zipper closure mechanism includes an elongated cable defining an end, the elongated cable operable to restrict movement of at least one zipper slider operably associated with a pocket compartment of the luggage case. The at least one securing recess is operable to releasably receive the end of the cable.

In one example, the pocket is on an exterior of the luggage case, and preferably forms a front pocket or a top pocket of the luggage case. In another example, the luggage case includes a sleeve coupled to the luggage case and the sleeve defines an internal cavity. The sleeve is configured to retractably receive at least a portion of the length of the cable into the cavity. In another example, an elastic coupler is coupled to the cable and is operable to resiliently extend at least a portion of the cable out of the cavity and retract at least a portion of the cable into the cavity. In another example, a cable guide is configured on the luggage case adjacent to the sleeve for receiving at least a portion of the length of the cable. The cable guide may define an aperture and the cable may be positioned to extend from the cavity and retract into the cavity through the aperture. The cable may be anchored in the cavity to hinder the cable from being removed from the luggage case, and the cable may define a second end opposite the end, with the second end is anchored in the cavity.

In some examples the second end is sufficiently sized to not pass through the aperture formed in the cable guide, and in some examples the sleeve is positioned on an outer side of the luggage case adjacent the pocket compartment. The sleeve may be elongated and may extend along a portion of the luggage case. At least a portion of the cable may be resiliently coiled such that at least a portion of the cable is selectively retractable into and extendible from the cavity. In some examples, a fixed securing element may be coupled to the luggage case near a pocket compartment and operable to releasably receive a portion of the cable therethrough, and the fixed securing element may include a D-shaped ring attached to the luggage case near a terminus of an opening into the pocket compartment. The zipper sliders may include an aperture operable to receive at least a portion of the cable therethrough, and/or a zipper pull-tab may be operably associated with the zipper slider and operable to receive at least a portion of the cable therethrough.

In another embodiment, a luggage case may include at least six sides defining an enclosed space, a first zipper track enclosing a first compartment of the enclosed space, a first zipper slider coupled to the first zipper track, a first zipper pull tab coupled to the first zipper slider, a second zipper track enclosing a second compartment of the enclosed space, second and third zipper sliders coupled to the respective second zipper track and each defining an aperture, a cable configured for selective engagement of the respective aperture of the second and third zipper sliders, and a lock mounted on one of the at least six sides. The zipper lock may be configured to receive the first zipper pull-tab and a portion of the cable.

In some examples, the lock includes a catch configured to selectively prevent the portion of the cable from being removed in a first state of operation; in some examples the catch includes a plate with a hook portion and a ridge portion, and the lock further includes a release member configured to selectively engage the ridge portion of the catch in order to selectively release the portion of the cable from the catch. In still other examples, the lock further includes a spring-loaded ejection member configured to bias the portion of the cable outwards of the dual lock.

In some examples, the luggage includes a third zipper track enclosing a third compartment of the enclosed space, fourth and fifth zipper sliders coupled to the respective third zipper track, and fourth and fifth zipper pulls tab coupled to the respective fourth and fifth zipper sliders, the fourth and fifth zipper pull tabs each including a respective aperture. The lock is configured to receive the first zipper pull-tab, a portion of the cable, and the fourth zipper pull-tab. In some examples, the luggage also includes a sleeve defining a recess formed adjacent the second compartment for movably receiving at least a portion of the cable within the recess, the cable having one end retained within the sleeve and an opposite end movable out of the sleeve to engage the lock mechanism. In still other examples, the luggage also includes a retraction mechanism operably associated with an end of the cable to retract at least a portion of the cable into the recess of the sleeve.

In another embodiment, a luggage case includes an outer structure defining at least one enclosed space, a zipper track enclosing a compartment of the enclosed space, first and second zipper slider assemblies coupled to the respective first zipper track, each of said zipper slider assemblies including an aperture, a cable configured for selective engagement of the respective apertures of the first and second zipper slider assemblies, and a lock mounted on the outer structure, the lock configured to selectively secure a first a portion of the cable.

In some examples, the lock includes a catch configured to selectively prevent the first portion of the cable from being removed in a first state of operation. In other examples, the catch includes a plate with a hook portion and a ridge portion, and the lock further includes a release member configured to selectively engage the ridge portion of the catch in order to selectively release the portion of the cable from the catch. In still other examples, the luggage includes a sleeve defining a recess formed adjacent the second compartment for movably receiving at least a portion of the cable within the recess, the cable having one end retained within the sleeve and an opposite end movable out of the sleeve to engage the lock mechanism.

This summary of the disclosure is given to aid understanding, and one of skill in the art will understand that each of the various aspects and features of the disclosure may advantageously be used separately in some instances, or in combination with other aspects and features of the disclosure in other instances.

DETAILED DESCRIPTION

Described herein is a dual lock system for a luggage case. The luggage case may have two or more zippered compartments. The dual lock system may include a locking device, which may be mounted on the luggage. The dual lock system may further include two sets of zipper pull tabs. Each set of zipper pull tabs may be associated with a compartment of the luggage case.

In some examples, each set of zipper pull tabs may be selectively secured to the locking device of a dual lock system. Each compartment associated with a respective set of zipper pull tabs may be selectively secured and unsecured by inserting and removing the zipper pull tabs in the locking device.

In other examples, one set of zipper pull tabs may be selectively secured to the locking device of a dual lock system, and a second set of zipper pull tabs may be selectively secured by a cable that is selectively secured to the locking device. The locking device may be operable with one or more combination dial(s), a key and tumblers, and so forth, and may in some but not all embodiments, include one or more release members that may be selectively actuated to release a set of the zipper pull tabs and/or the cable from the locking device.

Figure 1:
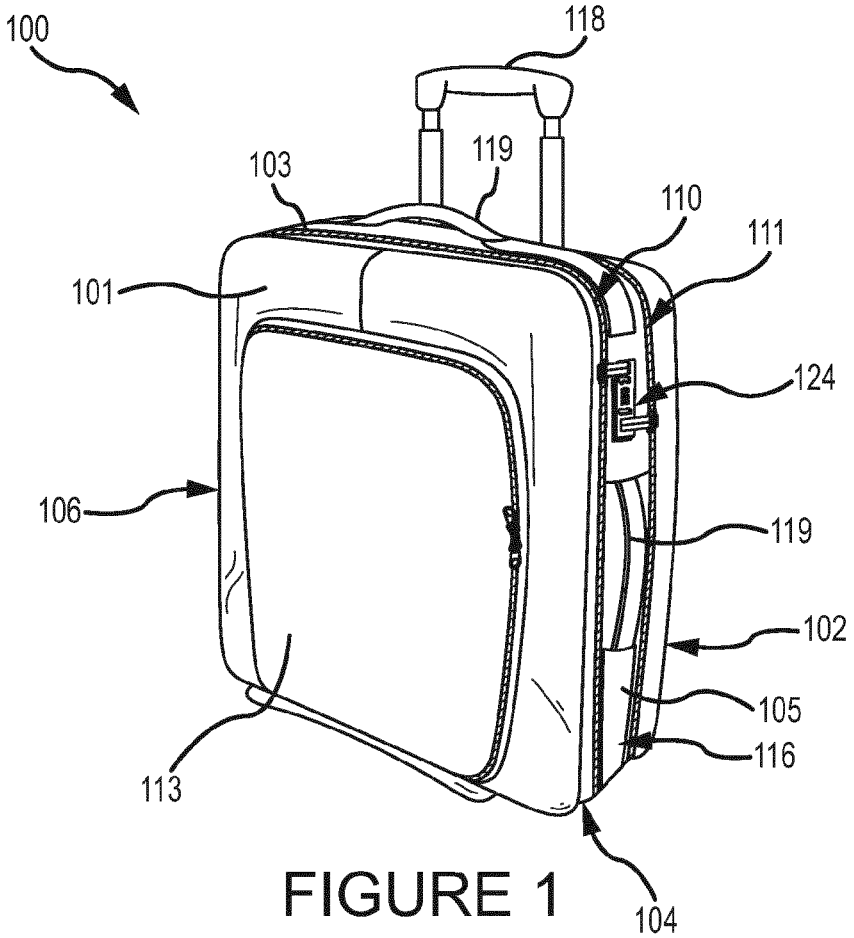
FIG. 1 shows a front perspective view of luggage case with a dual lock system.

FIG. 1 shows a front perspective view of a luggage case 100 with a dual lock system 124. With reference to FIG. 1 the luggage 100 may include a front side 101, a rear side 102, an upper side 103, a lower side 104, a right side 105, and a left side 106 that define an enclosed space 107. The enclosed space 107 may be divided into one or more compartments 110, 111. In some embodiments, the space may be divided into two main compartments—front 110 and rear 111, or first 110, and second 111.

The front side 101 and portions of the upper side 103, lower side 104, right side 105, and left side 106 of the luggage 100 may define at least a portion of the front compartment 110. The rear side 102, and portions of the upper side 103, lower side 104, right side 105, and left side 106 of the luggage 100 may define at least a portion of the rear compartment 111. As shown in FIG. 1, a middle frame 116 may be provided between and frame a part of both the front compartment 110 and rear compartment 111. The middle frame 116 may generally be made similar to the material from which, for example, the front side 101 and rear side 102 of the luggage 100 are made from, or the middle frame 116 may be made of a different type of material. Generally the luggage 100, including the front side 101, rear side 102, middle frame 116, and so forth, may be made of plastic, nylon, metal, or any other suitable material, including a combination of different materials.

The front compartment 110 may be referred to as a lid, and the rear compartment 111 may be referred to as a base; this terminology may particularly refer to the luggage 100 when it is oriented such that the rear side 102 is placed on a support surface such as the ground. The front compartment 110 and rear compartment 111 may be used in some embodiments, to store different types of articles. For example, work-related items may be stored in the front compartment 110, while personal items may be stored in the rear compartment 111. Or clean clothes may be stored in the front compartment 110 and dirty clothes stored in the rear compartment 111.

The front side 101 and portions of the upper side 103, lower side 104, right side 105, and left side 106 of the luggage 100 may be joined to the middle frame 116 by a hinge 117 (not visible in FIG. 1), and together these luggage portions may define the front compartment 110. Similarly, the rear side 102 and portions of the upper side 103, lower side 104, right side 105, and left side 106 of the luggage 100 may be joined to the middle frame 116 by a hinge 117 (also not visible in FIG. 1), and together these luggage portions may define the rear compartment 111. The hinges 117 may allow the front compartment 110 and rear compartment 111 to be pivoted relative to each other to different configurations while remaining joined via the hinge(s) 117. Specifically, the front side 101 of the luggage 100 shown in FIG. 1 may be pivoted relative to the middle frame 116 such that the front compartment 110 is opened, thus allowing a user to access the enclosed space 107. Similarly, the rear side 102 may be pivoted relative to the middle frame 116 such that the rear compartment 111 of the luggage 100 is opened, thus allowing a user to access the enclosed space 107. In the embodiment shown in FIG. 1, the hinges 117 of the luggage 100 are on the left side 106 of the luggage 100. In other embodiments, however, both hinges 117 may be on a different side (e.g. the right side 105, the lower side 104, etc.) of the luggage 100, or the two hinges 117 may be on different sides of the luggage 100. For example, the rear compartment 111 may hinge with the middle frame 116 on the left side 106 of the luggage 100, while the front compartment 110 hinges with the middle frame 116 on the lower side 104 of the luggage 100. Of course the luggage 100 may have more than two hinges 117 corresponding to more than two compartments 110, 111 as well.

The luggage 100 may further include one or more wheels (not shown in FIG. 1) joined to the luggage 100. The wheels may be fixed-axle wheels, spinner wheels, etc. In some embodiments, one or more feet or other supports may be joined to the luggage 100 to facilitate positioning and maintaining the luggage 100 in an upright position on a support surface, similar to the position for the luggage 100 shown in FIG. 1.

The luggage 100 may further include one or more handles. At least one of the handles may be a telescoping handle 118 that may be selectively moved between a retracted position and one or more extended positions. In an extended position, the telescoping handle 118 may be used to facilitate using the wheels to push or pull the luggage 100 along a support surface. In FIG. 1, the telescoping handle 118 is shown positioned within the rear compartment 111. The rear compartment 111 of the luggage 100 of FIG. 1 may be structured with a rigid or semi-rigid panel. Positioning a telescoping handle 118 within the rear compartment 111 may thus provide sufficient support to guide a luggage case 100 with wheels using the telescoping handle 118.

The luggage 100 may further include one or more fixed handles 119. In FIG. 1, two fixed handles 119, are shown: one joined to the middle frame 116 the upper side 103 of the luggage 100, and one joined to the middle frame 116 on the right side 105 of the luggage 100. The fixed handles 119 may be use to lift or carry the luggage 100. Of course, more or less than two fixed handles 119 could be joined to the luggage 100, and the handles 118, 119 could be joined to any portion of the luggage 100.

Also, the luggage 100 may in some embodiments include a front pocket 113 (as shown in FIG. 1), and other various features, such as a name tag identification area, side pockets, rear pockets, bumper guards, interior dividers and pockets, additional compartments, and so forth. Also, in some embodiments, the luggage 100 may be expandable, which may be provided for in several different ways.

The luggage 100 may further include two or more zippers closure mechanisms 125, 135 that provide access to the respective front compartment 110 and rear compartment 111. The first zipper closure mechanism 125 may include a first zipper track or tape 126, one or more zipper sliders 127, 128, and one or more zipper pull tabs 131, 132. The second zipper closure mechanism 135 may include similar components.

In FIG. 1, the first zipper track or tape 126 extends along at least some of the perimeter of the luggage 100 to provide access to the front compartment 110. A second zipper track or tape 136 extends along at least some of the perimeter of the luggage 100 and provides access to the rear compartment 111. One or more zipper sliders 127, 128, 137, 138 and corresponding pull tabs 131, 132, 141, 142 may be operatively associated with each respective zipper track 126, 136. Specifically a first zipper slider 127, a second zipper slider 128, a first zipper pull tab 131, and a second zipper pull tab 132 are associated with the first zipper track 126. A third zipper slider 137, a fourth zipper slider 138, a third zipper pull 141, and a fourth zipper pull tab 142 are associated with the second zipper track 136.

The luggage 100 may include a lock system 124, which may be a dual zipper lock system 124. The dual lock system 124 may include a locking device 145, and one or more zipper closure mechanisms, each of the zipper closure mechanisms associated with a pocket or compartment of the luggage case 100. The locking device 145 may be mounted on a portion of the luggage 100. FIG. 1 shows the locking device 145 mounted on an upper portion of the right side 105 of the luggage 100. The locking device 145, however, may be mounted in other places as well.

The locking device 145 of the dual lock system 124 may be mounted on or joined to the luggage 100 in any suitable manner, depending on the material used in constructing the luggage 100 (particularly the middle frame 116 or other region of the luggage 100 where the locking device 145 is to be mounted) and the material used in constructing the locking device 145. For example, the locking device 145 may be joined to the luggage 100 using adhesives, stitching, sonic welding, screws, and so forth. In one example, two holes may be made in the right side 105 of the luggage 100, such as in the middle frame 116 and/or the fabric forming the right side 105 of the luggage 100. The locking device 145 may have two receiving holes, and a corresponding plate (not shown) may also have two holes. The corresponding plate may be placed on the inside wall of the right side 105 of the luggage 100, and the locking device 145 may be placed on the outside wall of the right side 105 of the luggage 100, with the holes in the corresponding plate, in the middle frame 116, and in the locking device 145 aligned one with another. Two fasteners (not shown), such as screws, may be positioned within the aligned holes to join the locking device 145 to the corresponding plate, thereby sandwiching the middle frame 116 and/or fabric of the right side 105 of the luggage 100 between the locking device 145 and the plate. In another example, the locking device 145 may be joined to the luggage 100 using a high-strength adhesive. In still other examples, at least some portions of the locking device 145 may be formed together with the middle frame 116 during manufacture, such as in an injection molded plastic process.

The locking device 145 may include a housing 146. The housing 146 may be made of any suitable material, such as plastic, metal, reinforced nylon, wood, and so forth. Further, the shape and configuration of the housing 146 of the locking device 145 may vary widely. FIGS. 1 through 6 illustrate a housing 146 that is generally shaped as an elongated, rectangular box, defining an enclosed space. The housing 146 may have one or more sidewalls 148 that define the enclosed space. In other embodiments, however, the housing 146 may be shaped like a frustum, a wedge, a round cylinder, and so forth. Furthermore, the housing 146 may include a faceplate 147, bottom-plate, side-plate, or any other ornamental or structural components, or may not have any ornamentation at all. In some examples, the faceplate 147 of the housing 146 may define a main, planar face, and may also define one or more sidewalls 148 of the housing 146 that extend approximately perpendicularly from the main, planar face. The housing 146 of the locking device 145 may define chambers 151, 152, 153, 154 configured to receive one or more pull tabs 131, 132, 141, 142. In FIG. 1, the housing 146 defines four separate chambers 151, 152, 153, 154, each of which may be configured to receive a portion of a respective pull tab 131, 132, 141, 142, as explained below.

In some embodiments, the housing 146 of the lock device 145 may have a length defining a middle portion and opposing end portions. The middle and opposing end portions may generally be respective thirds of the housing 146 in some embodiments, whereas in other embodiments, one of the opposing end portions or the middle portion may generally be longer than one or more of the other two portions. In some embodiments, a locking mechanism 148 (described below) may be positioned along the middle portion of the lock housing, and/or one or more of the chambers or securing recesses 151, 152, 153, 154 may be positioned on opposing end portions of the lock housing. The locking mechanism 148 may be positioned along the middle portion of the lock housing in order to, for example, decrease the likelihood of the locking mechanism being snagged or bumped during luggage handing. The locking mechanism 148 may alternatively be positioned along the middle portion of the lock housing for aesthetic appeal or to simplify the internal components of the locking mechanism 148 (e.g., reduce the length of bars and connectors of the locking mechanism that engage zipper pull tabs or zipper sliders).

Figure 1A:
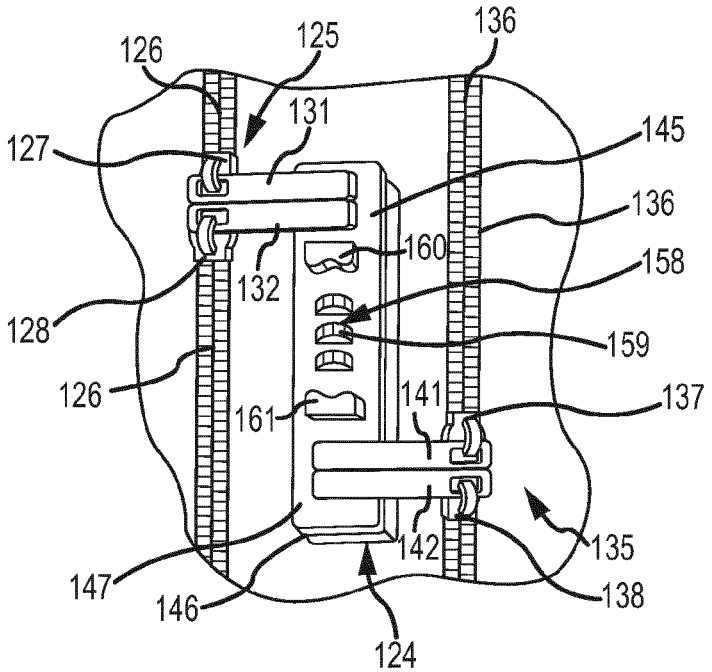
FIG. 1A shows an enlarged side view of the dual lock system of the luggage shown in FIG. 1.

In FIG. 1A, an enlarged side view of the dual lock system 124 is shown. With reference to FIG. 1A, both sets of pull tabs 131, 132, 141, 142 may be selectively secured to the locking device 145. The zipper pull tabs 131, 132, 141, 142 may be selectively secured via hasps 133, 134, 143, 144 positioned proximate the free ends of the zipper pull tabs 131, 132, 141, 142. To secure the zipper pull tabs 131, 132, 141, 142 to the locking device 145, the hasps 133, 134, 143, 144 for each zipper pull tab 131, 132, 141, 142 may be positioned within the chamber or receiving hole 151, 152, 153, 154 defined by the housing 146 of the locking device 145. More particularly, each zipper pull tab 131, 132, 141, 142 may be a generally planar structure with its respective hasp 133, 134, 143, 144 protruding perpendicularly from the pull tab 131, 132, 141, 142, although as explained below, the housing 146 of the locking device 145 may be designed to receive any type of zipper pull tab 131, 132, 141, 142. One or more shafts contained within the housing 146 may be selectively engaged and disengaged with the hasp 133, 134, 143, 144 protruding perpendicularly from each zipper pull tab 131, 132, 141, 142 to selectively secure and release each pull tab 131, 132, 141, 142 to/from the dual locking device 145, as described in more detail below in connection with FIG. 2. FIG. 1A also shows the hasps 143, 144 of the third and fourth zipper pull tabs 141, 142 received within two receiving holes 153, 154 in the lower portion of the housing 146 of the locking device 145.

The locking device 145 may include a locking mechanism 158 disposed within the housing 146 of the locking device 145. The locking mechanism 158 may include, for example, a combination lock. The combination lock may include three circular combination dials 159 disposed in the middle of the faceplate 147 of the housing 146. In other embodiments, however, the combination dials 159 may be placed on one or more of the sides 148 of the housing 146. Generally, the dials 159 may be placed in any location on the dual lock system 124 and oriented in any manner. The orientation of the dials 159 in some of these embodiments may be changed from the face of the dials 159 being perpendicular to the right side 105 of the luggage 100 (as shown in FIG. 1A) to the face of the dials 159 being parallel to the right side 105 of the luggage 100.

The combination dials 159 of the dual lock system 124 may be coupled to one or more release member(s) 160, 161 such that when the combination dials 159 are aligned according to a pre-determined combination, the locking mechanism 158 within the locking device 145 unlocks and allows the release member(s) 160, 161 to move, in turn releasing one or more zipper pull tabs 131, 132, 141, 142, as described in greater detail below. Although FIG. 1A shows two release members 160, 161, the dual lock system 124 may in some embodiments only have a single release member 160 that, when moved, releases all of the zipper pull tabs 131, 132, 141, 142 received within the housing 146. The one or more release member(s) 160, 161 may be disposed on an outer surface of the locking device 145 and therefore available to be engaged by a user. The one or more release member(s) 160, 161 may be coupled to the combination dials 159 or other locking mechanism 158 within the locking device 145 via a shaft or other connection mechanism. The shaft or other connection mechanism may couple the release members 160, 161 to the locking mechanism 158 via a hole, whose cross-section may in some embodiments be larger than the cross-section of the shaft or other connection mechanism in order to allow the release members 160, 161 to be engaged. In general, the release members 160, 161 may be engaged in any manner, such as sliding in any direction along an outer surface of the housing 146, being depressed into the housing 146, and so forth.

When both of the zipper pull tabs 131, 132, 141, 142 associated with a zipper track 126, 136 are secured to the locking device 146, their corresponding zipper sliders 127, 128, 137, 138 are prevented from being moved along the zipper tracks 126, 136 because they are forced to remain at or near the portion of the zipper track 123, 136 adjacent to the locking device 145. By stopping movement of the sliders 127, 128, 137, 138 along their respective slider tracks 126, 136, unauthorized access to the compartments 110, 111 through the zipper tracks 126, 136 may be prevented. Furthermore, should an unauthorized person maliciously attempt to break the teeth of the zipper tracks 126, 136 to gain access to the secured compartments 110, 111, the person would be unable to conceal the breaking-in because the zipper pull tabs 131, 132, 141, 142 would remain secured to the locking device 145.

Figure 2:
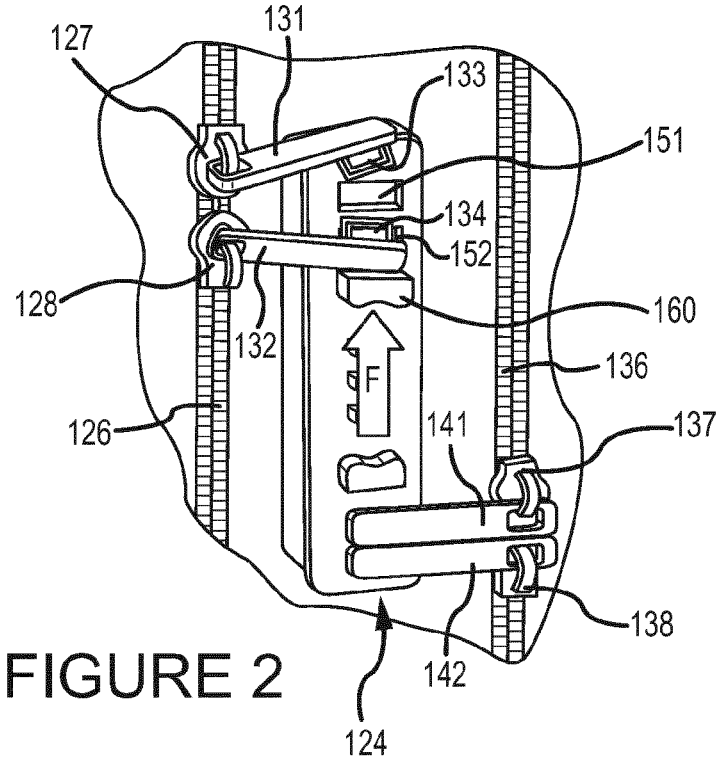
FIG. 2 shows the dual lock system of FIG. 1A with a first pair of pull tabs released from the locking device.
Figure 2A:
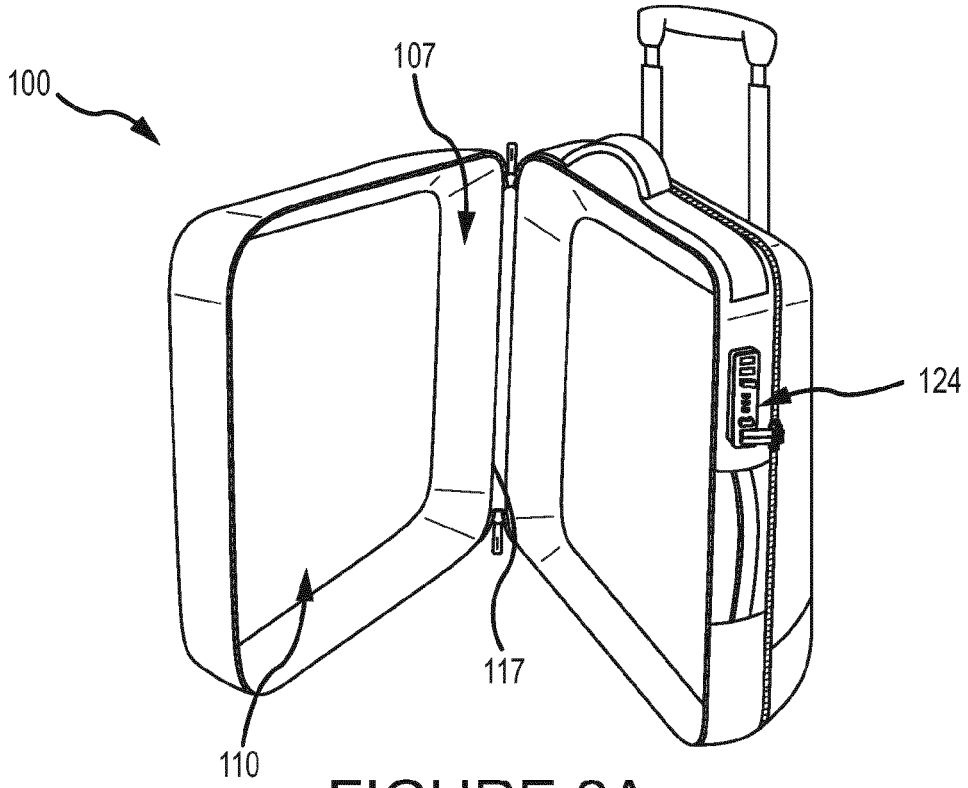
FIG. 2A shows a front perspective view of the luggage shown in FIG. 1A with the front compartment in an open configuration as a result of the first pair of pull tabs in FIG. 2 being released from the locking device and the corresponding zipper being unzipped.
Figure 3:
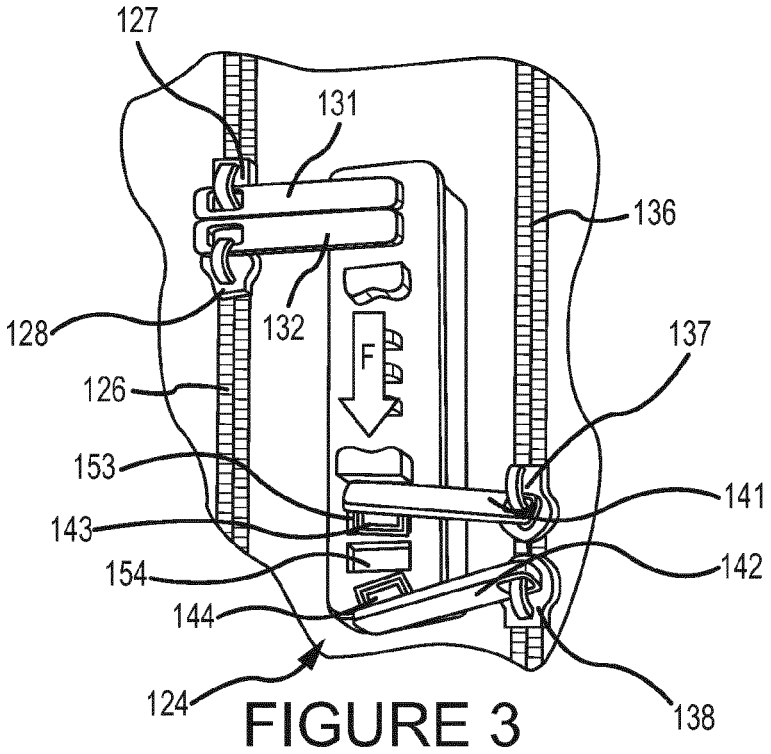
FIG. 3 shows the dual lock system of FIG. 1A with a second pair of pull tabs released from the locking device.
Figure 4:
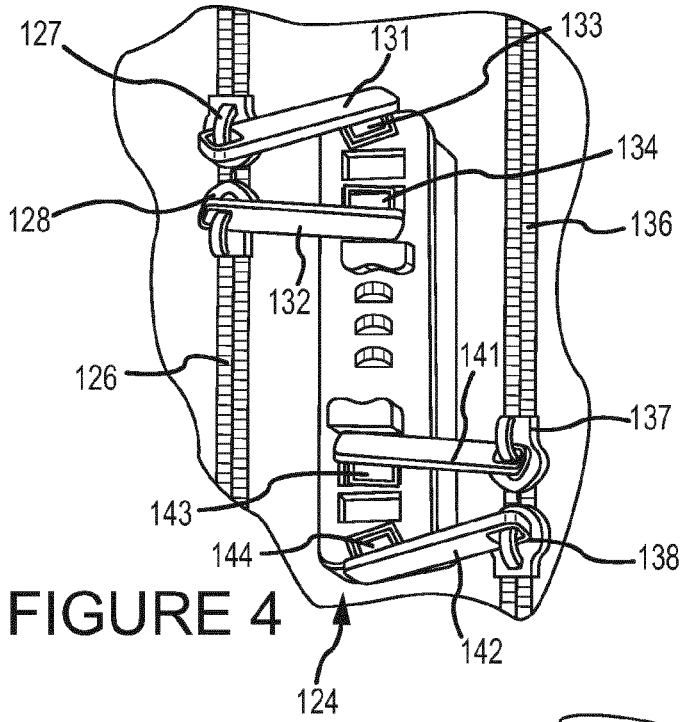
FIG. 4 shows the dual lock system of FIG. 1A with both pairs of pull tabs released from the locking device.

FIGS. 2 through 4 illustrate how the dual lock system 124 of FIGS. 1 and 1A may be operated. In FIG. 2, the dual lock system 124 is shown with the first pair of zipper pull tabs 131, 132 released from the locking device 145, and the second pair of zipper pull tabs 141, 142 secured to the locking device 145. Specifically, the combination dials 159 are aligned according to the pre-determined combination, which may unlock at least a portion of the locking mechanism 158. Then, the first release member 160 may be engaged (one example of which is shown by sliding force F), which actuates the one or more shafts that secure the hasps 133, 134 of the first pair of pull tabs 131, 132. Specifically, the shaft or shafts may slide out of the apertures 133, 134 or hasps of the pull tabs 131, 132, thereby allowing the pull tabs 131, 132 to be disconnected from the locking device 145 (or in some cases, forcing or pushing the pull tabs 131, 132 out). This then allows a user to slide one or both of the zipper sliders 127, 128 along the zipper track 126 by using the associated zipper pull tabs 131, 132, and thereby unseal the front compartment 110 and gain access to the enclosed space 107 of the luggage 100. FIG. 2A shows the luggage 100 with the front compartment 110 in an open configuration as a result of the first pair of pull tabs 131, 132 in FIG. 2 being disconnected from the locking device 145 and the corresponding zipper sliders 127, 128 being translated along the zipper track 126.

Figure 3A:
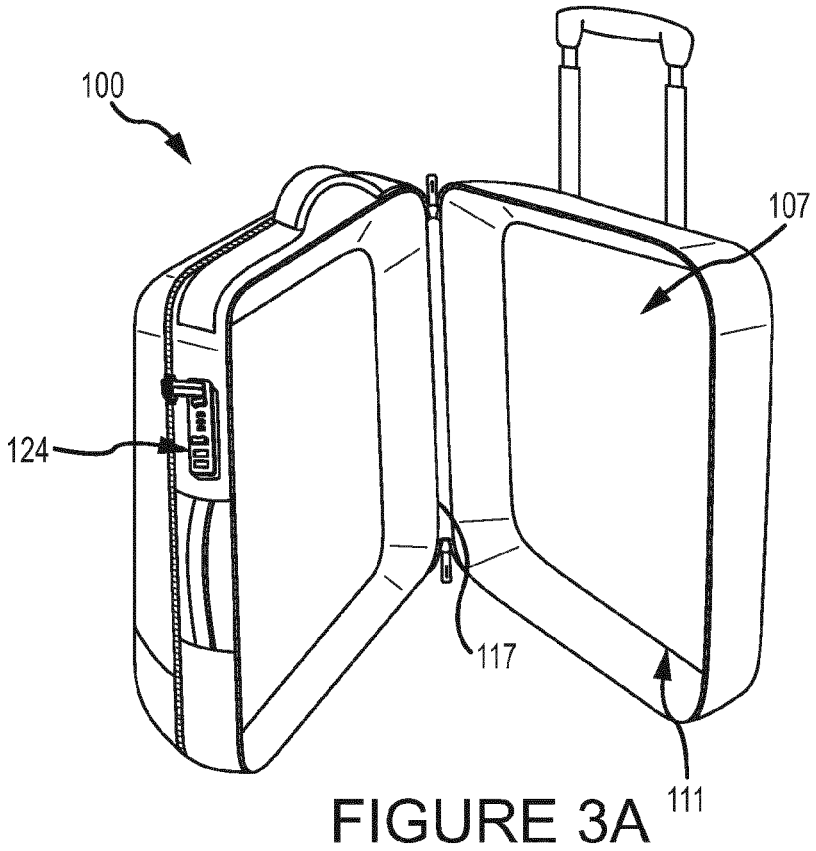
FIG. 3A shows a front perspective view of the luggage shown in FIG. 1A with the rear compartment in an open configuration as a result of the second pair of pull tabs in FIG. 3 being released from the locking device and the corresponding zipper being unzipped.

In FIG. 3, the dual lock system 124 is shown with the second pair of zipper pull tabs 141, 142 released from the locking device 145, and the first pair of zipper pull tabs 131, 132 secured to the locking device 145. Specifically, the combination dials 159 are aligned according to the predetermined combination, which may unlock at least a portion of the locking mechanism 158. Then, the second release member 161 is engaged (one example of which is shown by sliding force F), which actuates the one or more shafts that secure the hasps or apertures 143, 144 second pair of pull tabs 141, 142. As described above, the shaft or shafts may slide out of the aperture or hasps 143, 144 of the pull tabs 141, 142, thereby allowing the pull tabs 141, 142 to be disconnected from the locking device 145 (or in some cases, forcing or pushing the pull tabs 141, 142 out). This then allows a user to slide one or both of the zipper sliders 137, 138 along the zipper track 136 by using the associated zipper pull tabs 141, 142, and thereby unseal the rear compartment 111 and gain access to the enclosed space 107. FIG. 3A shows the luggage 100 with the rear compartment 111 in an open configuration as a result of the second pair of pull tabs 141, 142 in FIG. 3 being disconnected from the locking device 145 and the corresponding zipper sliders 137, 138 being translated along the zipper track 136.

Figure 4A:
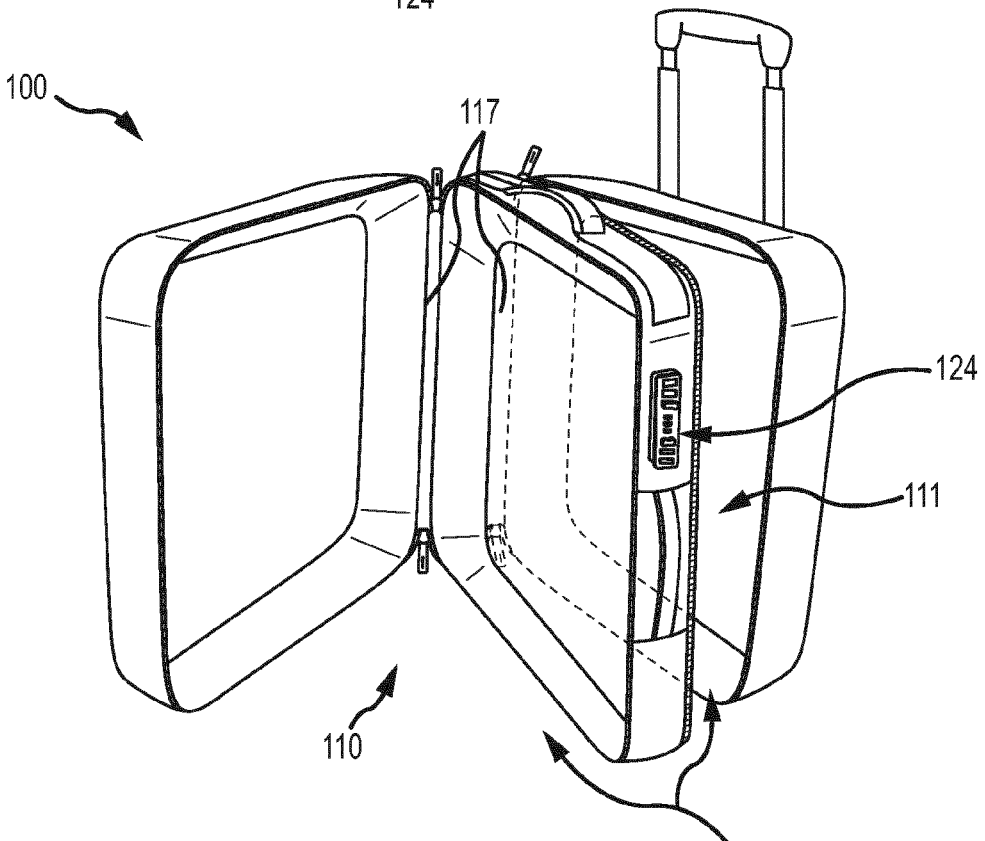
FIG. 4A shows a front perspective view of the luggage shown in FIG. 1A with the front and rear compartments in open configurations as a result of both pairs of pull tabs in FIG. 4 being released from the locking device and the corresponding zippers being unzipped.

In FIG. 4, the dual lock system 124 is shown with the first and second pairs of zipper pull tabs 131, 132, 141, 142 released from the locking device 145. Specifically, the combination dials 159 are aligned according to the predetermined combination, which may unlock a portion or all of the locking mechanism 158. Then the first and second release members 160, 161 are engaged, which actuates the one or more shafts that secure the hasps 133, 134, 143, 144 of both pairs of pull tabs 131, 132, 141, 142. As described above, the shaft or shafts may slide out of the aperture or hasps 133, 134, 143, 144 of the pull tabs 131, 132, 141, 142, thereby allowing the pull tabs 131, 132, 141, 142 to be disconnected from the locking device 145 (or in some cases, forcing or pushing the pull tabs 131, 132, 141, 142 out). This then allows a user to slide one or more of the zipper sliders 127, 128, 137, 138 along the zipper tracks 126, 136 by using the associated zipper pull tabs 131, 132, 141, 142, and thereby unseal the front and rear compartments 110, 111 and gain access to the enclosed space 107. FIG. 4A shows the luggage 100 with the front and rear compartments 110, 111 in an open configuration as a result of the all of the pull tabs 131, 132, 141, 142 in FIG. 4 being disconnected from the locking device 145 and the corresponding zipper sliders 127, 128, 137, 138 being translated along the zipper tracks 126, 136.

The combination dials 159 shown in FIGS. 1 through 4 may be configured in several different ways. For example, the combination dials 159 may be configured with one, two, or more different combinations. The first combination may unlock only a portion of the locking mechanism 158 and thereby allow only the first pair of zipper pull tabs 131, 132 to be released. The second combination may unlock a different portion of the locking mechanism 158 and thereby allow only the second pair of zipper pull tabs 141, 142 to be released. A third combination may unlock the entire locking mechanism 158 and thereby allow all of the zipper pull tabs 131, 132, 141, 142 to be released. In some embodiments, however, only a single or unique combination may be used to selectively unlock all of the zipper pull tabs 131, 132, 141, 142.

Figure 5A:
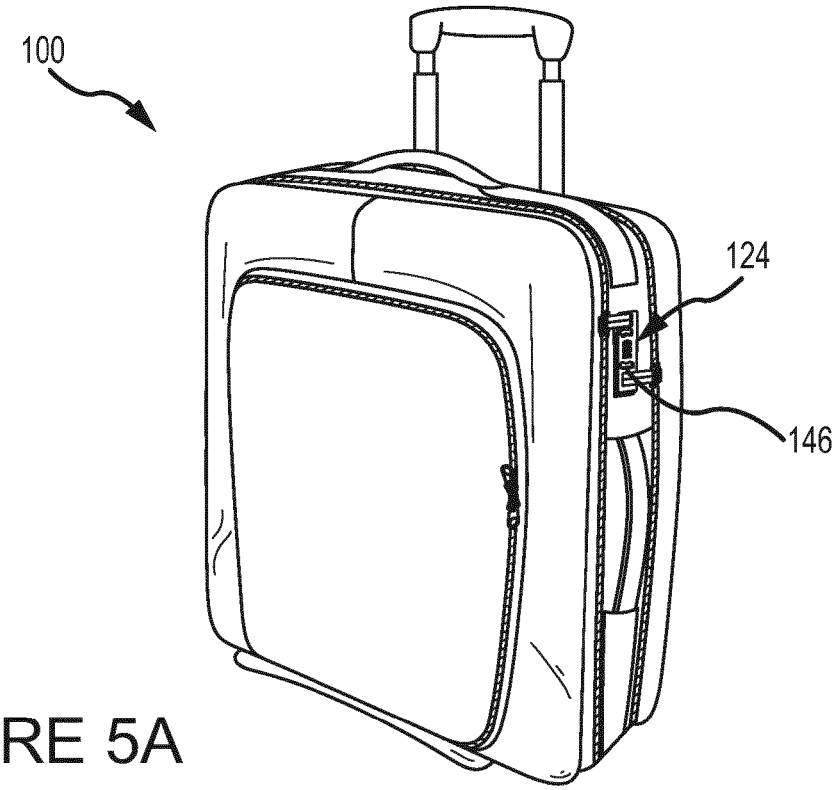
FIG. 5A shows a front perspective view of a luggage case with a dual lock system mounted on an upper portion of the right side of the luggage.
Figure 5B:
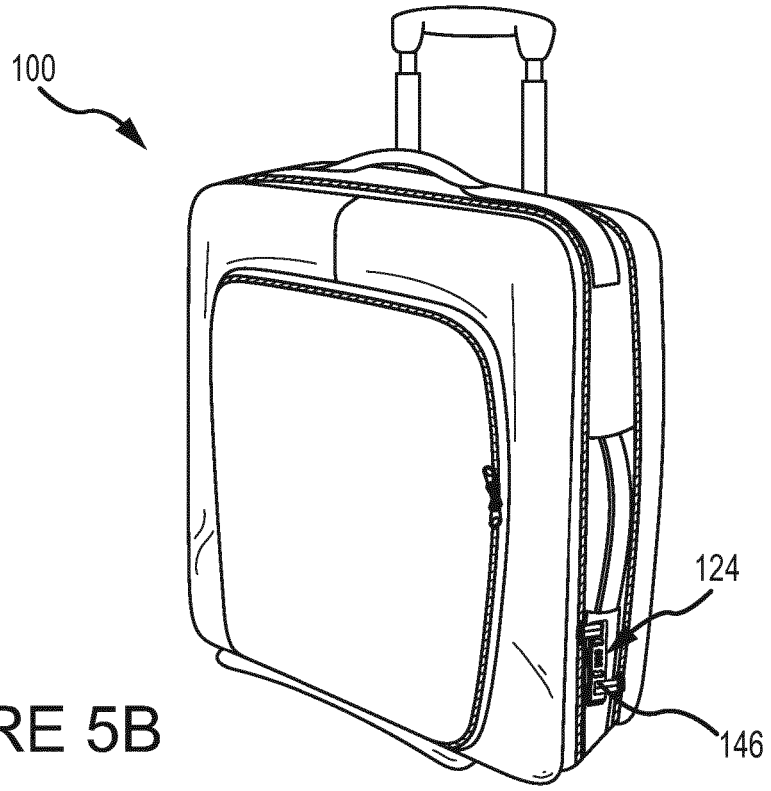
FIG. 5B shows a front perspective view of a luggage case with a dual lock system mounted on a lower portion of the right side of the luggage.
Figure 5C:
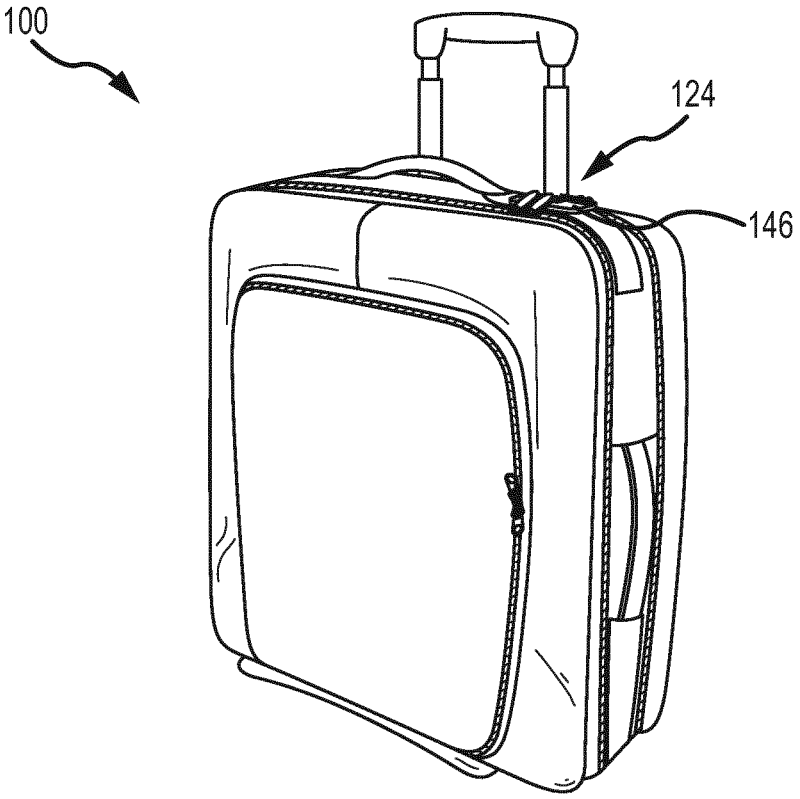
FIG. 5C shows a front perspective view of a luggage case with a dual lock system mounted on an upper side of the luggage.

Many other variations and modifications to the dual lock system 124 shown in FIGS. 1 through 4 are possible. For example, FIGS. 5A through 5C illustrate that the locking device 145 of the dual lock system 124 may be mounted in several different places on the luggage 100. Specifically, FIG. 5A shows the locking device 145 of the dual lock system 124 mounted on an upper portion of the right side 105 of the luggage 100. FIG. 5B shows the locking device 145 of the dual lock system mounted on a lower portion of the right side 105 of the luggage 100. Also, FIG. 5C shows the locking device 145 of the dual lock system 124 mounted an upper side 103 of the luggage 100. The locking device 145 of the dual lock system 124 may also be mounted in other places as well, such as on the lower side 104 of the luggage 100.

Figure 6A:
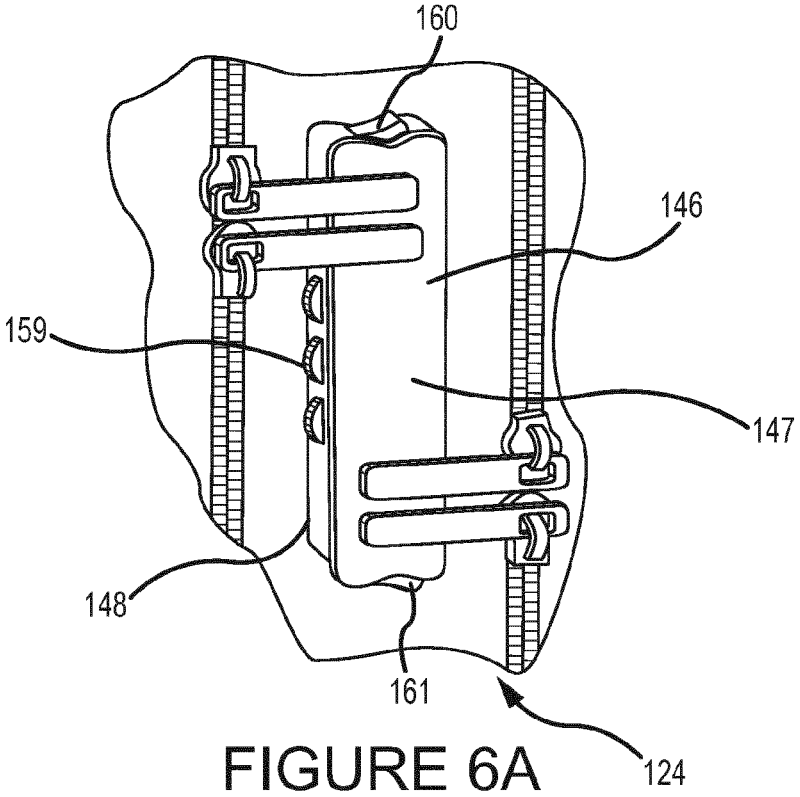
FIG. 6A shows an embodiment of a dual lock system with release members on the top and bottom of the lock system mounting base.

FIGS. 6A through 6E illustrate a few additional variations that may be made to the dual lock system 124 shown in FIGS. 1 through 5, although many other variations and modifications are also possible. In FIG. 6A an embodiment of the dual lock system 124 is shown with release members 160, 161 on the top and bottom walls 148 of the locking device 145 rather than on its faceplate 147 as in FIGS. 1 through 5. The release members 160, 161 in FIG. 6A, or in any of the other examples described and/or shown herein, may be actuated by pushing or some other action. The release members 160, 161 may also be placed on other portions of the locking device 145, such as on the left or right side walls 148 of the housing 146. FIG. 6A also shows the dials 159 of the combination lock 158 placed on a sidewall 148 of the housing 146 of the locking device 145. Examples of locking mechanisms 158 that may be used in the embodiment shown in FIG. 6A include those described in U.S. Pat. No. 6,202,455 to Su and/or U.S. Pat. No. 5,557,954 to Ling, or other locking mechanisms known in the art.

Additionally, although not shown in FIGS. 1 through 6, in some embodiments the locking device 145 of the dual lock system 124 may not have any release members. In these embodiments the locking mechanism 158 may unlock when the combination dials 159 are aligned appropriately in that the shaft securing the hasps 133, 134, 143, 144 of the pull tabs 131, 132, 141, 142 is released such that the pull tabs 131, 132, 141, 142 can be manually removed by a user or automatically pop out without any action by release members.

Figure 6B:
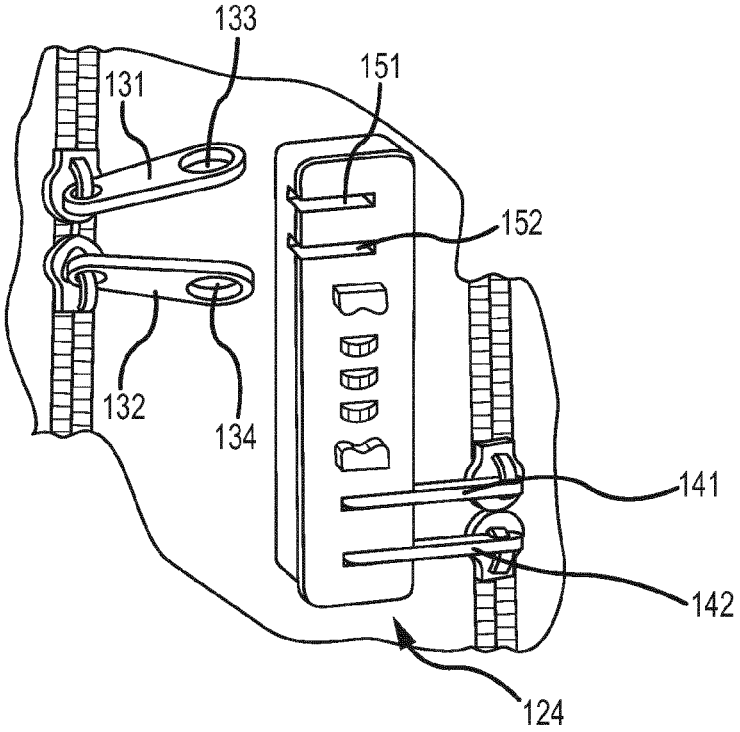
FIG. 6B shows an embodiment of a dual lock system for use with pull tabs that have an aperture defined by the pull tab.

FIG. 6B shows an embodiment of a dual lock system 124 for use with pull tabs 131, 132, 141, 142 different than the pull tabs 131, 132, 141, 142 shown in FIGS. 1 through 6A. Specifically, rather than having a hasp 133, 134 extend perpendicularly from a generally planar zipper pull tab 131, 132, the zipper pull tabs 131, 132 shown in FIG. 6B have respective apertures defined in the generally planar surface of the pull tabs 131, 132, themselves. Accordingly, the pull tabs 131, 132, 141, 142 are inserted and removed from the locking device 145 such that the planar surfaces of the zipper pull tabs 131, 132, 141, 142 are perpendicular to the right side 105 of the luggage 100, rather than being inserted and removed such that the planar surfaces of the zipper pull tabs 131, 132, 141, 142 are parallel to the right side 105 of the luggage 100, as in FIGS. 1 through 6A.

Figure 6C:
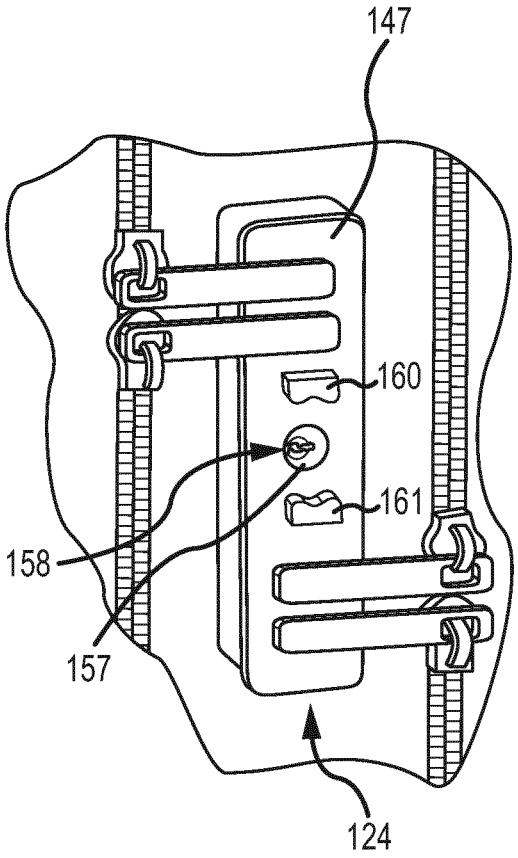
FIG. 6C shows an embodiment of a dual lock system with a locking mechanism operable with a key.

In FIG. 6C, an embodiment of a dual lock system 124 is shown with a locking mechanism 158 operable with a key instead of combination dials 159. For example, the locking mechanism 158 within the locking device 145 may unlock when the key is inserted to turn the key receptacle 157 to a first position, and may lock when the key is inserted to turn the key receptacle 157 to a second position. The one or more release members 160, 161 may be actuated to release the pull tabs 131, 132, 141, 142 only when the key receptacle 157 is turned to the first position. Although FIG. 6C shows a key receptacle 157 oriented in the middle of the faceplate 147 of the dual lock system 124, the key receptacle 155 may be placed in other locations as well, such as near the top or bottom of the faceplate 147, or on the left side, right side, top side, or bottom side of the body of the locking device 145.

Additionally, in some embodiments, the locking device 145 of FIGS. 1 through 6 may include both a set of combination dials 159 and a key receptacle 157. Such a dual lock system 124 may allow a user to release the pull tabs 131, 132, 141, 142 when either a key is used or the correct combination is used, or may require both the key and the combination in order to release the pull tabs 131, 132, 141, 142. In some embodiments, the dual lock system 124 may be configured to open with a universal or master key and/or master combination (depending on which or both of the key or combination dials are used). For example, a government security screening agency may be given the master key and/or master combination to facilitate screening of locked luggage 100.

Also, similar to the discussion above regarding the combination dials 159 having more than one combination, the dual lock system 124 with a key receptacle 157 as shown in FIG. 6C may have a locking mechanism 158 that responds differently to different keys. For example, a first key may allow the first set of zipper pull tabs 131, 132 to be released and the front compartment 110 opened, while a second key may allow the second set of zipper pull tabs 141, 142 to be released and the rear compartment 111 opened, and a third key may allow all of the zipper pull tabs 131, 132, 141, 142 to be released and therefore allow both compartments 110, 111 to be opened. Also, a single key may be used with a key receptacle 157 that may be turned to two or more positions; a first position allowing the first pair of pull tabs 131, 132 to be released, a second position allowing the second pair of pull tabs 141, 142 to be released, a third position allowing all of the pull tabs 131, 132, 141, 142 to be released, etc. In some embodiments, however, only a single key may be used.

In some embodiments, rather than securing pull tabs 131, 132, 141, 142 associated with a first compartment 110 and a second compartment, the dual lock system 124 may be used to secure one pair of pull tabs associated with a compartment, and a second pair of pull tabs associated with an expander mechanism of the luggage (not shown). For example, in embodiments with an expander mechanism that expands the luggage 100 by unzipping one or more pull tabs, the dual lock system 124 may be configured to receive the one or more pull tabs may associated with the expander mechanism in addition to the pull tabs associated with a main compartment.

Figure 6D:
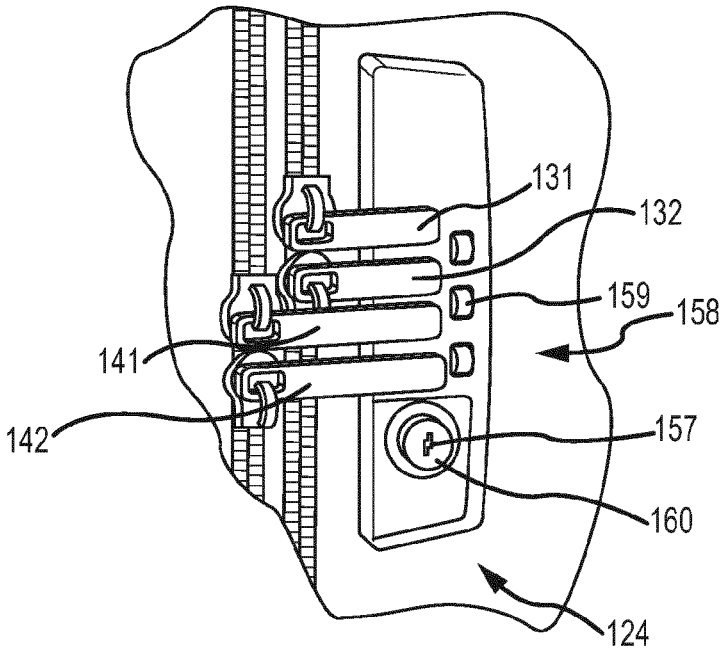
FIG. 6D shows another embodiment of a dual lock system.
Figure 6E:
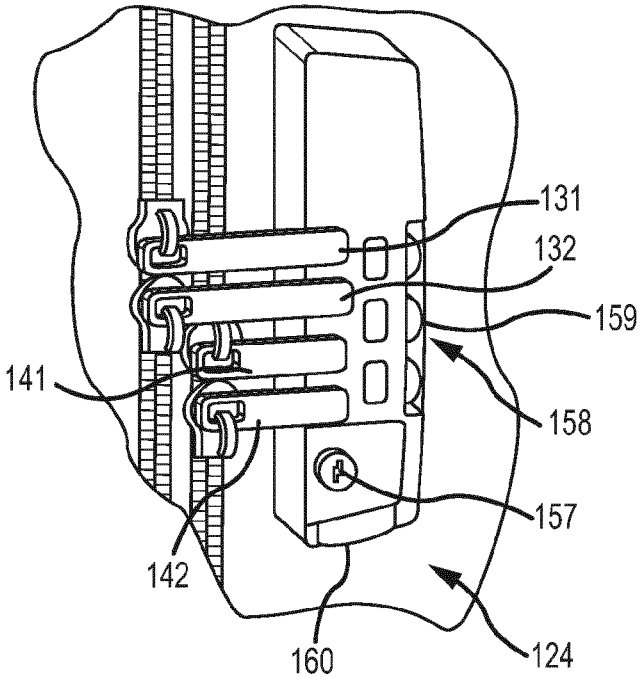
FIG. 6E shows another embodiment of a dual lock system.

FIGS. 6D and 6E illustrate additional embodiments of a locking device 145. With reference to FIG. 6D, the locking device 145 may include a key receptacle 157 mounted in a single actuator member 160 that slides back and forth to selectively release the internal lock mechanism 158, which may be controlled by the combination dials 159. With reference to FIG. 6E, the locking device 145 may include a single actuator member 160 on the side of the housing 146 of the locking device 145. In the embodiments illustrated in both FIGS. 6D and 6E, the combination dials 159 (and therefore the locking mechanism 158) may be located along the center portion of the locking device 145, and the actuator member 160 may be located on one of two opposing end portions of the locking device. As illustrated in FIGS. 6D and 6E, the securing recesses may also be located along the middle portion of the locking device 145.

Figure 7:
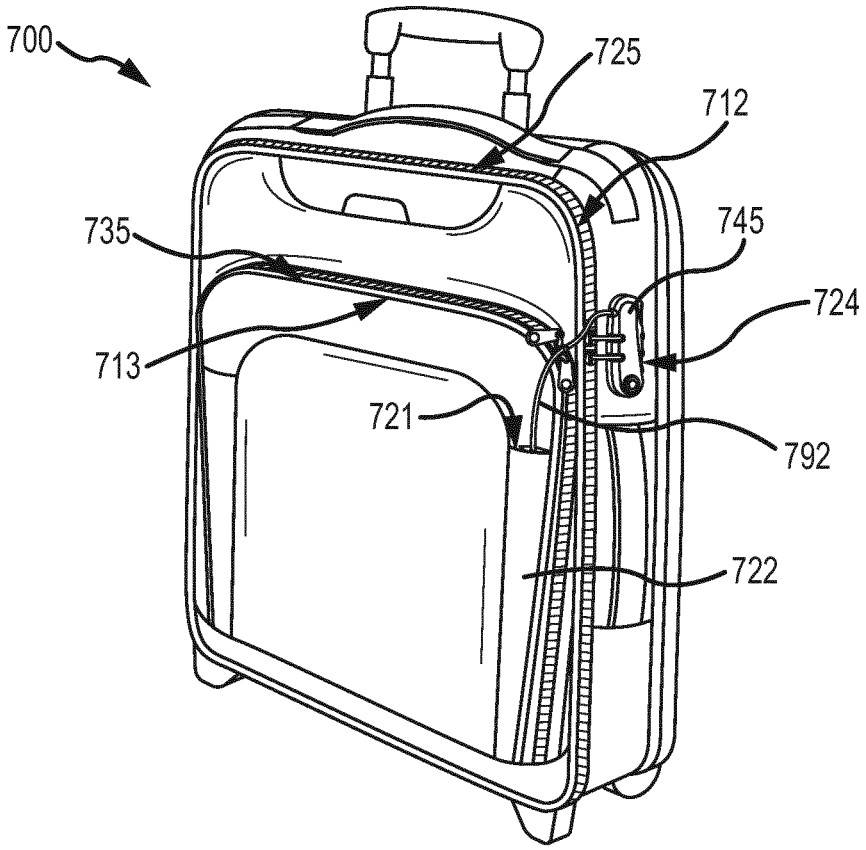
FIG. 7 shows a front perspective view of a luggage case with a dual lock system, similar to the dual lock system shown in FIG. 1.

FIG. 7 shows a front perspective view of a luggage case 700 with a dual lock system 724, which may in some respects be similar to the dual lock system 124 described above in connection with FIG. 1. Similar to the luggage case 100 shown in FIG. 1, the luggage 700 shown in FIG. 7 may include a front side, a rear side, an upper side, a lower side, a right side, and a left side that define an enclosed space or volume. As shown in FIG. 7, the front side of the luggage case is secured to the front perimeter edges of the upper, lower, left, and right sides by a first, or peripheral, zipper closure mechanism 725 or other fastener type structure and defines a main compartment 712. The front side is pivotally connected to allow at least a portion of the front side to swing, pivot, or otherwise move away from the front peripheral edge and allow a user access to the enclosed space for packing and unpacking. The front side may be attached or secured to a portion of the front peripheral edge by a hinge structure.

Similar to the luggage 100 shown in FIG. 1, the luggage 700 shown in FIG. 7 may include one or more wheels, fixed handles, telescoping handles, and so forth. One main compartment of the luggage 700 may be secured by the first zipper closure mechanism 725. Still with reference to FIG. 7, the luggage 700 may include a front pocket compartment 713 that is secured by a second zipper closure mechanism 735.

Each of the first and second zipper closure mechanisms 725, 735 may provide access to the respective compartments 712, 713 secured by the respective zipper closure mechanisms 725, 735. The zipper closure mechanisms 725, 735 may each include a zipper tape or track that extends along at least a portion of the perimeter of the main compartment 712 and the front pocket 713. One or more zipper slider assemblies, each including a zipper slider 727, 728, 737, 738 and a corresponding pull tab 731, 732, 741, 742 may be operatively associated with each zipper tape or track. In some cases, two zipper slider assemblies, each with a corresponding pull tab, are associated with each of the first and second zipper tracks. One or more zipper sliders 737, 738, may have one or more apertures 739, 740 formed thereon, the apertures 739, 740 sized and positioned so as to allow the shackle of a removable lock and/or a cable 792 (described in more detail below) to be positioned therethrough, in order to lock the sliders 727, 728 together. The cable 792, as part of the second zipper closure mechanism 735 may, together with the zipper sliders 737, 738 selectively secure the front pocket compartment 713 of the luggage case 700. In some examples, each zipper slider 737, 738 includes a single aperture 739, 740, whereas in other examples, each zipper slider includes two or more apertures, which are typically arranged parallel to one another. For convenience and clarity of description and illustration of the figures, dual apertures 739, 740 will be shown and described for each zipper slider 737, 738, but it is contemplated that each zipper slider 737, 738 include one, or more than two apertures 739, 740 in other examples.

The luggage case 700 of FIG. 7 may include a dual lock system 724. The dual lock system 724 may include a locking device 745, one or more zipper sliders 727, 728, 737, 738 and associated pull tabs 731, 732, 741, 742, and a cable operably secured to the luggage case 700. The locking device 745 may be mounted on a portion of the luggage 700. With reference to FIG. 7, the locking device 745 may be mounted on an upper portion of the right side of the luggage 700. The locking device 745, however, may alternatively or additionally be mounted in other locations on the luggage case 700. Similar to the locking device 745 describe above with reference to FIG. 1, the locking device 745 shown in FIG. 7 may be mounted on or joined to the luggage 700 in any suitable manner, depending on the materials used in constructing the luggage 700.

The locking device 745 may include a housing 746 having a face plate 747, a bottom plate, and/or one or more sidewalls 748 that enclose various components of the locking mechanism 758. In some embodiments, the faceplate 747 may define one or more sidewalls 748 extending therefrom. The housing 746 may be made of any suitable material, such as plastic, metal, reinforced nylon, wood, a combination of the same, and so forth. Further, the shape and configuration of the housing 746 of the locking device 745 may vary widely. The housing 746 (in this specific case, the face plate 747) may define one or more securing recesses 751, 752, 753 in the form of slots, chambers or receiving holes, each configured to receive and releasably secure at least a portion of either a pull tab 731, 732 or a portion of a cable 792, or both, as explained in more detail below.

Figure 8A:
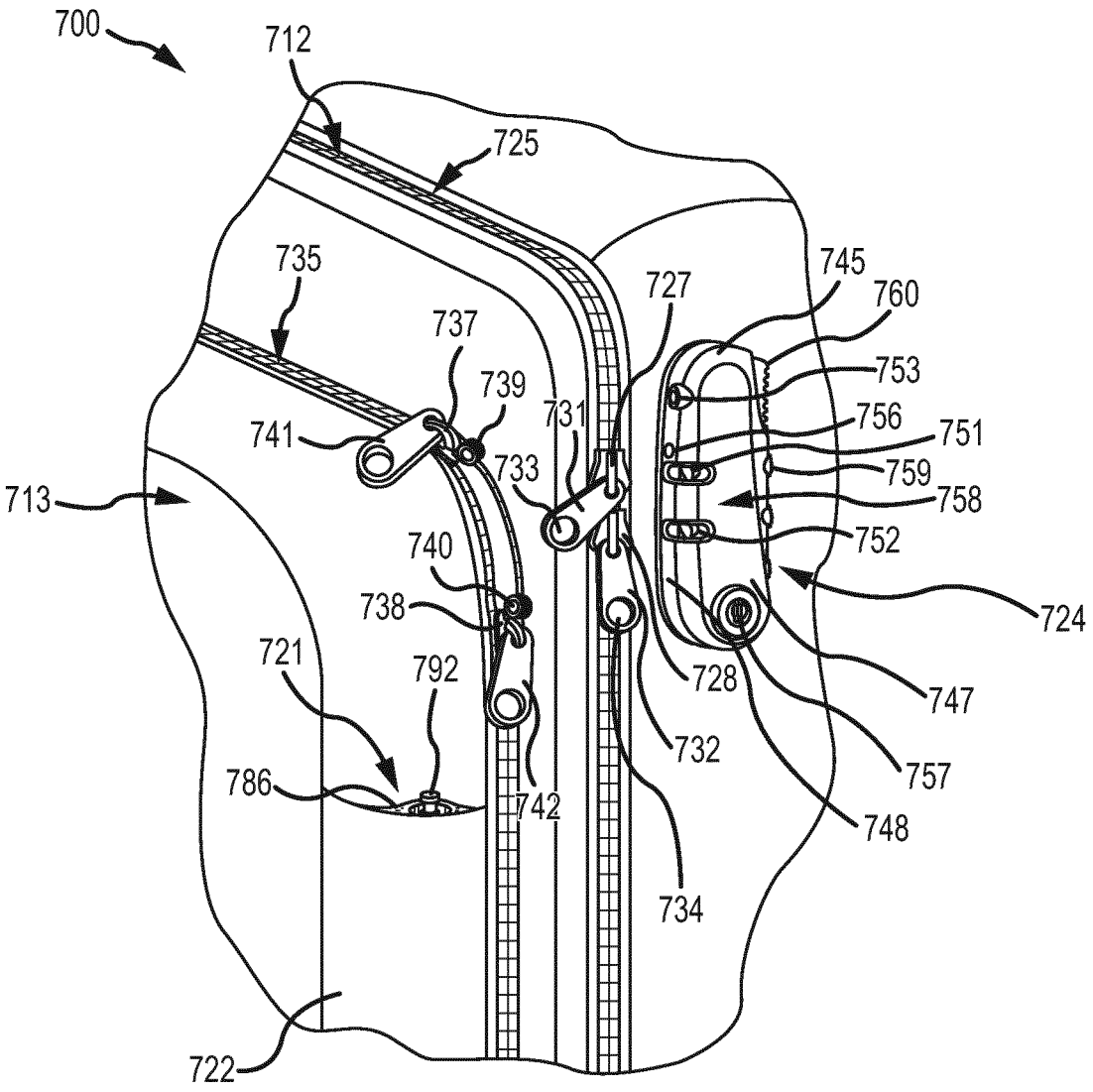
FIGS. 8A and 8B show an enlarged perspective view of the dual lock system of the luggage case shown in FIG. 7.
Figure 8B:
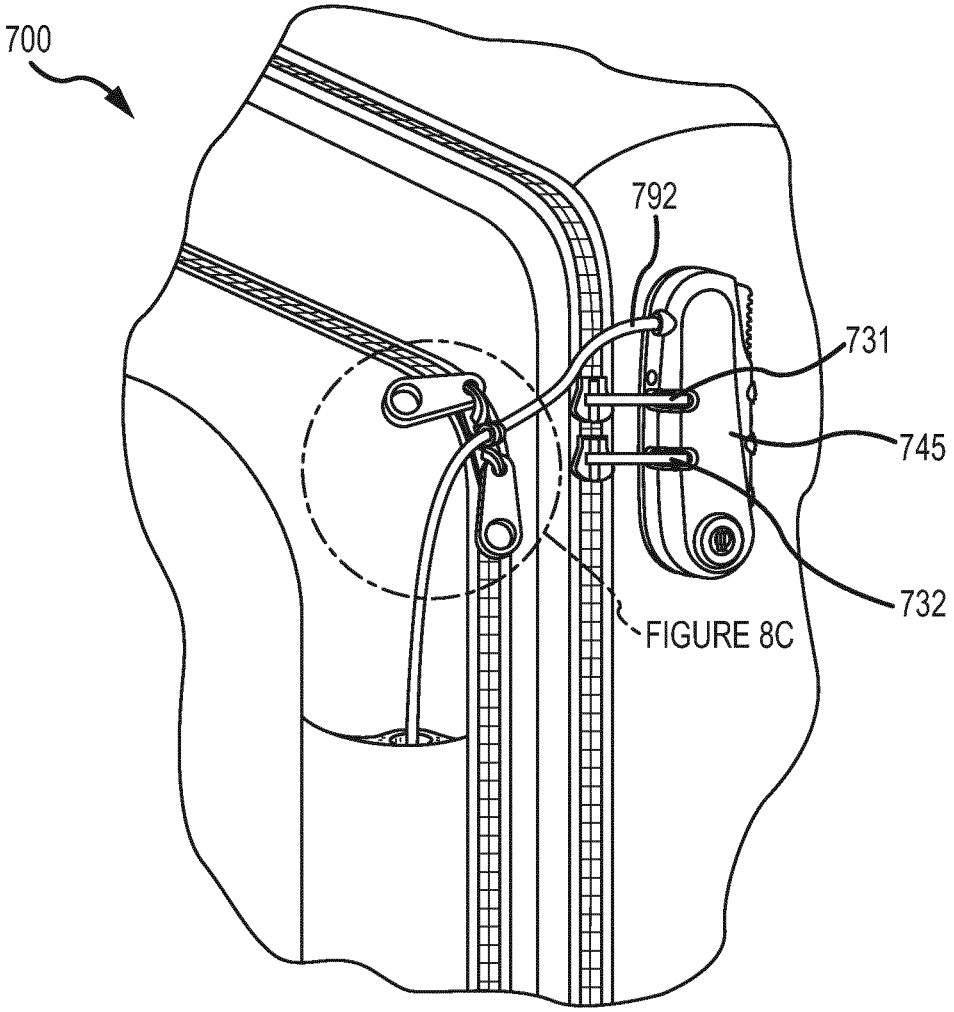
Figure 8C:
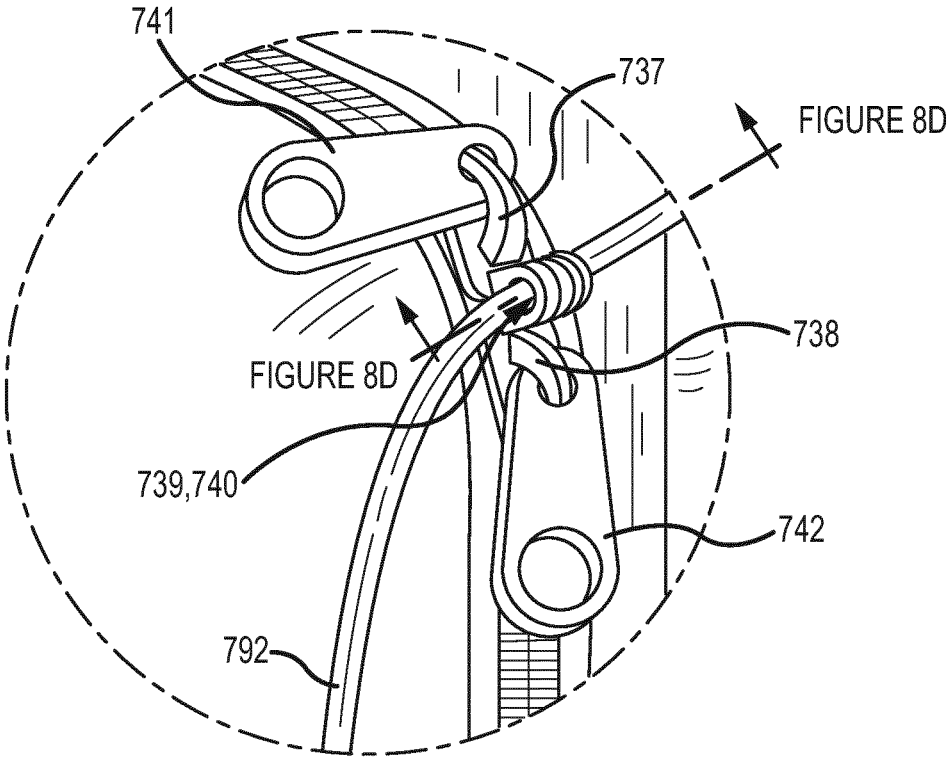
FIG. 8C shows an enlarged perspective view of the dual lock system of the luggage shown in FIG. 8B.
Figure 8D:
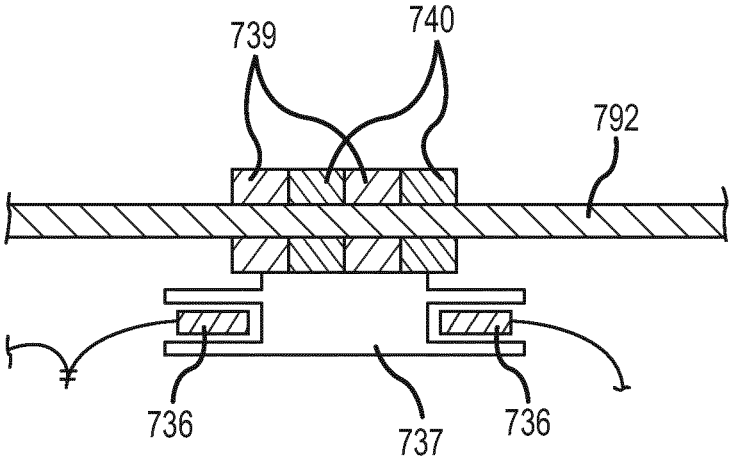
FIG. 8D shows a cross section view of the cable and zipper sliders shown in FIG. 8C.

With reference to FIGS. 8A and 8B, an example of the locking device 745 for a front pocket compartment 713 utilizing a cable 792 is shown. In general, a first zipper pull tab 731 and a second zipper pull tab 732 associated with first and second zipper sliders 727, 728 of the first zipper closure mechanism 725 may be selectively secured to the locking device 745. The zipper pull tabs 731, 732 are selectively secured to the locking device 745 by positioning each of the hasps or apertures 733, 734 for each zipper pull tab 731, 732 within a corresponding receiving recess 751, 752 defined by the housing 746. One or more shafts contained within the locking device 745 may selectively engage and disengage the hasps or apertures 733, 734 of the respective zipper pull tabs 731, 732 to selectively secure and release the pull tabs 731, 732 to/from the locking device 745, as described in more detail below.

Still with reference to FIGS. 8A and 8B, third and fourth zipper sliders 737, 738 of the second zipper closure mechanism 735 associated with the front pocket compartment 713 may be selectively secured by a cable 792 that is in turn secured to the locking device 745. The cable 792 provides a means for locking closed the front pocket compartment 713 zipper closure mechanism 735 since the third and fourth zipper sliders 737, 738 are positioned on the luggage case 700 at a location spaced away from the locking device 745 and the pull tabs 741, 742 of the third and fourth zipper sliders 737, 738 cannot reach the locking device 745.

Each zipper slider 737, 738 of the front pocket compartment 713 zipper closure mechanism 735 (i.e. the second zipper 735) may include hasps or apertures 739, 740 configured to receive the cable therethrough. To secure these third and fourth zipper sliders 737, 738 together to hinder access to the front pocket 713, the hasps or apertures 739, 740 may be brought into alignment such that the cable 792 may be inserted through the aligned hasps or apertures 739, 740 of either or both zipper sliders 737, 738. The cable may then extend to and reach the lock device 745, where a connector portion 801 of the cable 792 may be received within a locking recess 753 (such as a receiving hole 753) defined by the housing 746 of the locking device 745. A catch or securing mechanism may selectively engage and disengage the connector portion 801 of the cable 792, as described below, to selectively secure and release the cable 792 to/from the locking device 745.

With reference to FIG. 8B, when the first and second zipper pull tabs 731, 732 and the cable 792 are secured within the locking device 745, the first and second zipper sliders 727, 728 are hindered from being moved separately along the first zipper track. The third and fourth zipper sliders 737, 738 on the front pocket compartment 713 zipper closure mechanism 735 are prevented from being separated from one another due to the cable 792 passing through the apertures 739, 740. By thus preventing or hindering movement of the first and second zipper sliders 727, 728 away from the locking device 724, and by preventing or hindering movement of the third zipper slider 737 relative to the fourth zipper slider 738, unauthorized access to the main compartment and to the front pocket compartment 713 is restricted.

Figure 9A:
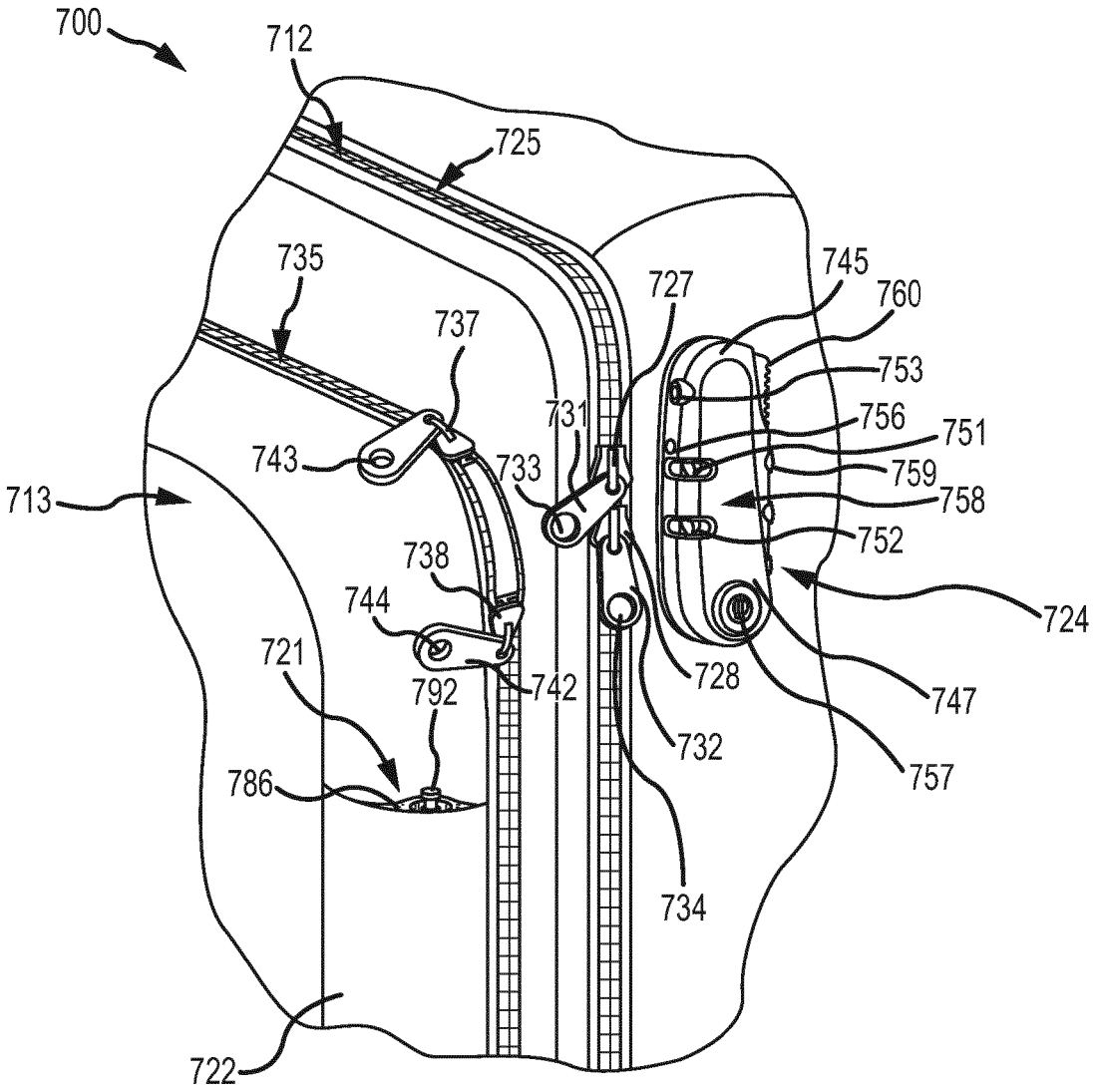
FIGS. 9A through 9C show an enlarged perspective view of a luggage case with a dual lock system, similar to the dual lock systems shown in FIGS. 1 and 7.
Figure 9B:
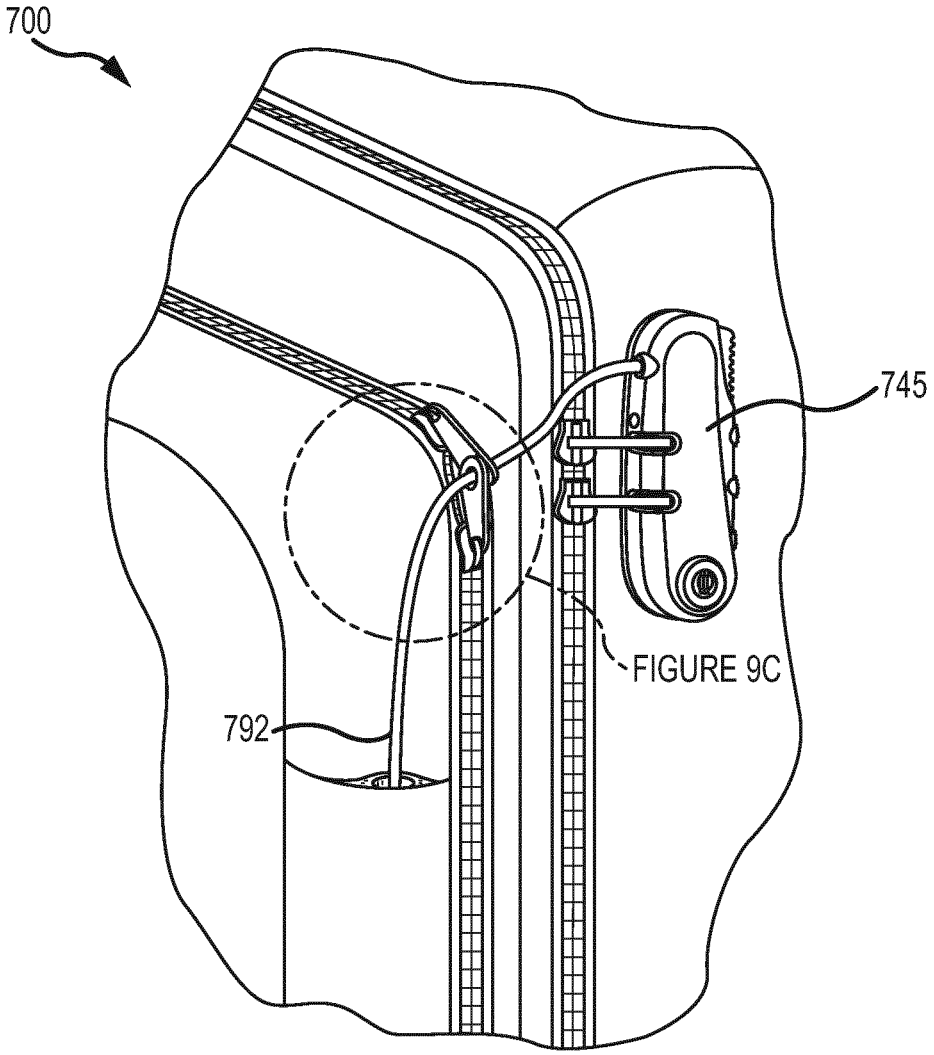
Figure 9C:
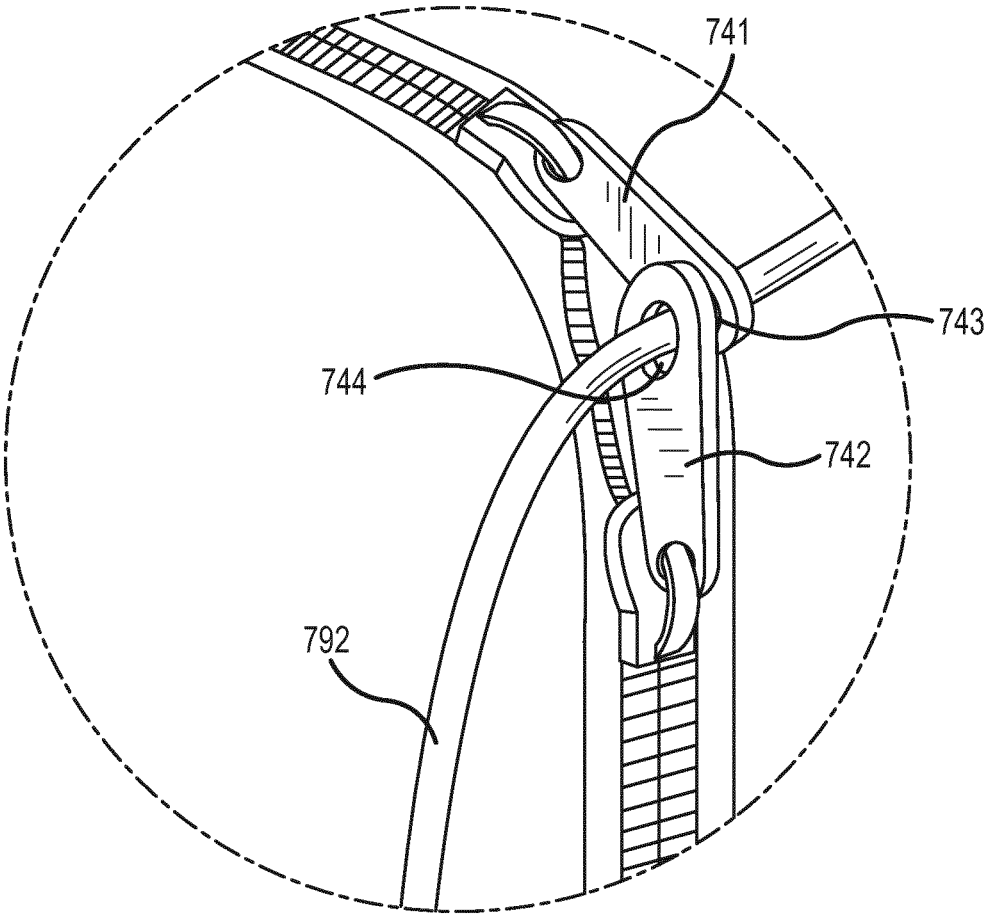

As described in more detail below with reference to FIGS. 9A through 9C, it is contemplated that the cable 792 may be received through hasps or apertures formed in the pull tabs 741, 742 of the front pocket compartment 713 zipper closure mechanism 735 to similarly hinder unwanted access to the front pocket compartment 713. In addition to, or as an alternative to the zipper sliders 727, 728, 737, 738 each including apertures 739, 740, one or more of the zipper pull tabs 731, 732, 741, 742 may include a hasp or aperture 733, 734, 743, 744 distal the connection of the zipper pull tab 731, 732, 741, 742 to the zipper slider 727, 728, 737, 738, or adjacent a free end thereof. The hasp or aperture 733, 734, 743, 744 may include a generally circular, square, or other shaped opening in the zipper pull tab 731, 732, 741, 742, or the hasp or aperture 733, 734, 743, 744 may be in the form of an arched protrusion from the lateral surface of the zipper pull tab 731, 732, 741, 742. The hasp or aperture 733, 734, 743, 744 of the zipper pull tab 731, 732, 741, 742 may be sized and positioned so as to allow the shackle of a removable lock and/or a cable 792 to be positioned therethrough, so as to secure the zipper pull tab 731, 732, 741, 741 (and corresponding zipper slider 727, 728, 737, 738) to a fixed location. Generally, the hasp or aperture 733, 734, 743, 744 of the zipper pull tab 731, 732, 741, 742 may be sized similar to the zipper slider aperture(s) 739, 740 described above—e.g., may be approximately twice the diameter as the cable 792. When the zipper pull tabs 731, 732, 741, 742 are adjacent to one another on the zipper tape or track, the respective hasps or apertures 733, 734, 743, 744 may at least partially overlap or be proximate one another, thereby allowing the cable 792 to be placed therethrough. It is also contemplated that the cable 792 can be placed therethrough even if the respective hasps or apertures 733, 734, 743, 744 do not overlap.

With reference to FIGS. 8A through 8D, the operation of the dual lock system 724 is now described. In FIG. 8A, the dual lock system 724 is shown with the first and second zipper pull tabs 731, 732 released from the locking device 745 and the cable 792 also released from the locking device 745. In FIG. 8B, the dual lock system 724 is shown with the first and second zipper pull tabs 731, 732 secured within the locking device 745 and the cable 792 also secured within the locking device 745. In order to secure the first and second zipper pull tabs 731, 732 within the locking device 745 as shown in FIG. 8B, the first and second zipper pull tabs 734, 732 may be positioned into the respective locking recesses 751, 752 of the locking device 745 housing 746. A shaft or pin may in turn be received through the apertures 733, 734 formed in the end of the pull tabs 731, 732 to secure the pull tabs 731, 732 to the locking device 745.

Continuing with FIGS. 8A and 8B, in order to secure the front pocket compartment 713, the apertures 739, 740 of the third and fourth zipper sliders 737, 738 may be positioned proximate one another, the cable 792 may be extended and positioned through the apertures 739, 740 of the third and fourth zipper sliders 737, 738, and the connector portion 801 of the cable 792 may be positioned within the appropriate securing recess 753 formed in the housing 746 of the locking device 745.

In order to release the first and second zipper pull tabs 731, 732 from the locking device 745 and also to release the cable 792 from the locking device 745, the combination dials 759 are aligned according to the predetermined condition or an appropriate key is placed into the key receptacle 757, which may unlock at least a portion of the locking mechanism 758. Once the correct combination is set, or the key is inserted and turned, a release member 760 may be actuated, which in turn actuates one or more shafts that secure the hasps 733, 734 of the first and second pull tabs 731, 732 in their respective locking recesses 751, 752, and also actuates a securing element that secures the connector portion 801 of the cable 792. The hasps 733, 734 of the first and second pull tabs 731, 732 and the cable may then be removed or ejected from the locking device 745. The connection portion 801 of the cable 792 may then be retracted back through the hasps 739, 740 of the third and fourth zipper sliders 737, 738 to allow the third and fourth zipper sliders 737, 738 to move relative to one another and allow access to the front pocket compartment 713.

As mentioned above, and now with reference to FIGS. 9A through 9C, the cable 792 may be received through the hasps or apertures 743, 744 formed in the zipper pull tabs 741, 742 of the front pocket compartment 713 zipper closure mechanism 735, rather than through the apertures 739, 740 of the zipper sliders 737, 738 to similarly hinder unwanted access to the pocket compartment 713. In some cases, the cable 792 may be received through one hasp or aperture 734, 744 of a zipper pull tab 741, 742 and through an aperture 739, 740 of a zipper slider 737, 738. In general, the cable 792 may be received through any combination of zipper pull tab hasps 741, 742 or apertures 743, 744 and zipper slider 737, 738 apertures 739, 740. Generally, the functionality, structure, and operation of the locking device 745 in FIGS. 9A through 9C may be similar to the locking device 745 in FIGS. 8A through 8D.

Figure 10A:
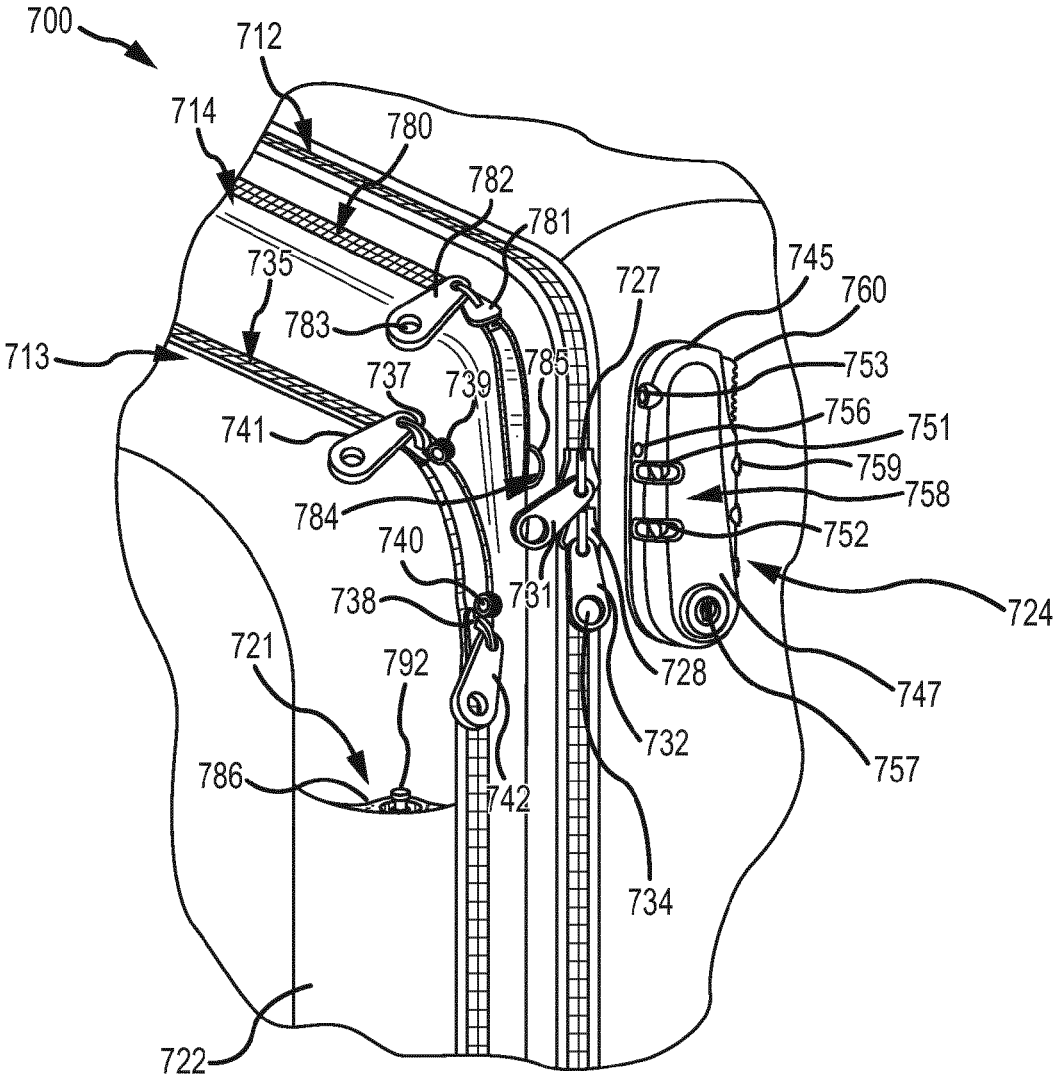
FIGS. 10A through 10C show enlarged perspective views of a luggage case with a dual lock system, similar to the dual lock systems shown in FIGS. 1, 7, and 9A through 9B.

With reference to FIGS. 10A through 100, some luggage cases 700 may include a top pocket compartment 714 in addition to a front pocket compartment 713. The top pocket compartment 714 may be positioned along a top portion of the front side of the luggage case 700 and may be, for example, four inches in height and as wide as the front side of the luggage case 700. The top pocket compartment may be secured by a top zipper closure mechanism 780, which may include a top zipper tape or track and a top zipper slider 781, a top zipper pull tab 782, and so forth. Like the front pocket zipper closure mechanism 735, the top pocket zipper closure mechanism may also include the cable 792. The top zipper slider 781 may include an aperture in some examples, and/or, with reference to FIG. 10A, the top zipper pull tab 782 may include a top zipper pull tab hasp or aperture 783. The top zipper slider aperture and/or the top zipper pull tab hasp or aperture 783 may be sized to receive a cable 792, which may be the same cable 792 described above. For example, the top zipper slider aperture and/or the top zipper pull tab hasp or aperture 783 may have an opening that is approximately double the diameter of the cable 792 in some examples.

A fixed securing element 784 may be positioned near one end of the top zipper closure mechanism 780 as shown for example in FIG. 10A. For example, the fixed securing element 784 may be positioned near the terminus of the top zipper 780 when the top zipper 780 is closed. The fixed securing element 784 may be a ring, for example a D-shaped ring 785 in some embodiments, and may be coupled to the luggage case 700 by any means of securing, such as by rivets or stitching. The fixed securing element 784 may, of course, take a different suitable form and maybe coupled to the luggage case 700 in any suitable manner. In some examples, the fixed securing element 784 may be coupled between the top zipper tape and a panel or reinforcing piping for the lid of the luggage case 700. In other examples, the fixed securing element 784 may be coupled to a side panel of the luggage case 700, to the front compartment pocket 713, or to another suitable location on the luggage case 700. The fixed securing element 784 may be sized to receive the cable 792.

To secure the top zipper closure mechanism 780, the cable 792 may be passed through the aperture 783 of the zipper pull tab 782 and through the fixed securing element 784, and finally be received in the locking device 745. In this way, the fixed securing element 784 and the top zipper slider 781 aperture and/or the top zipper pull tab 782 hasp or aperture 783 in combination with the cable 792 may selectively secure the top pocket compartment 714 of the luggage case 700 to hinder access thereto.

Figure 10B:
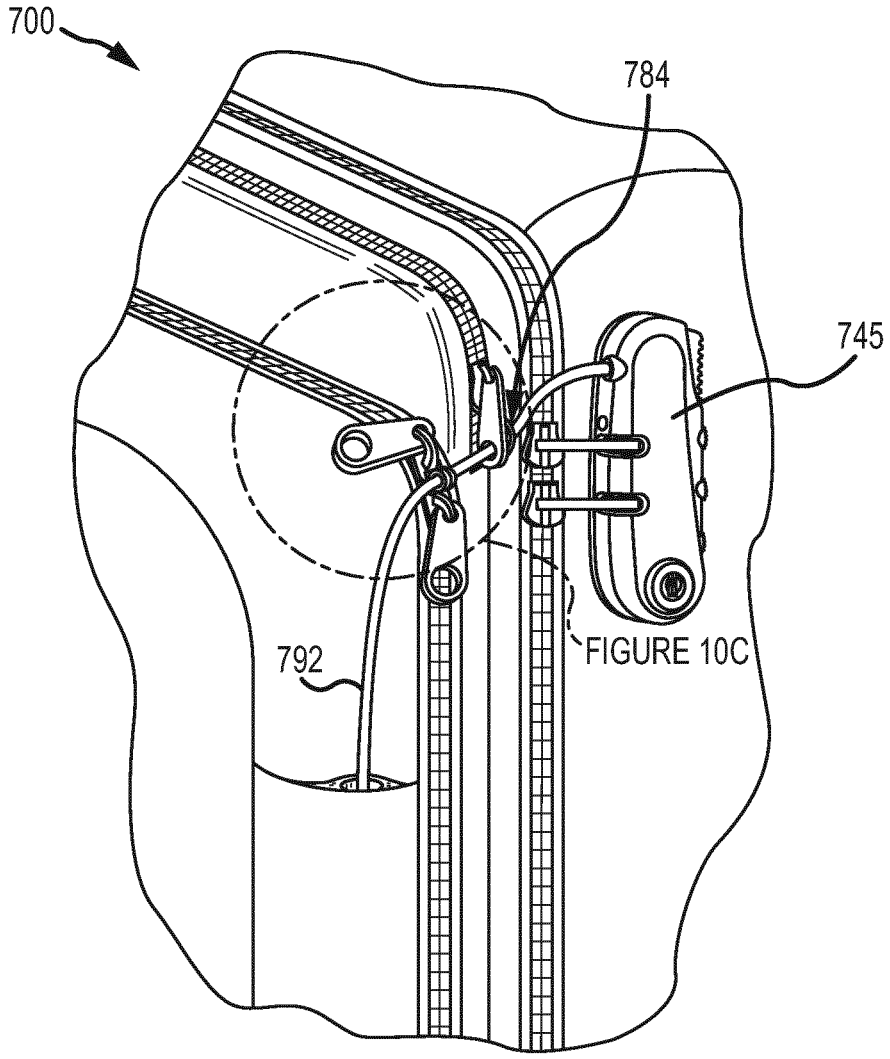
Figure 10C:
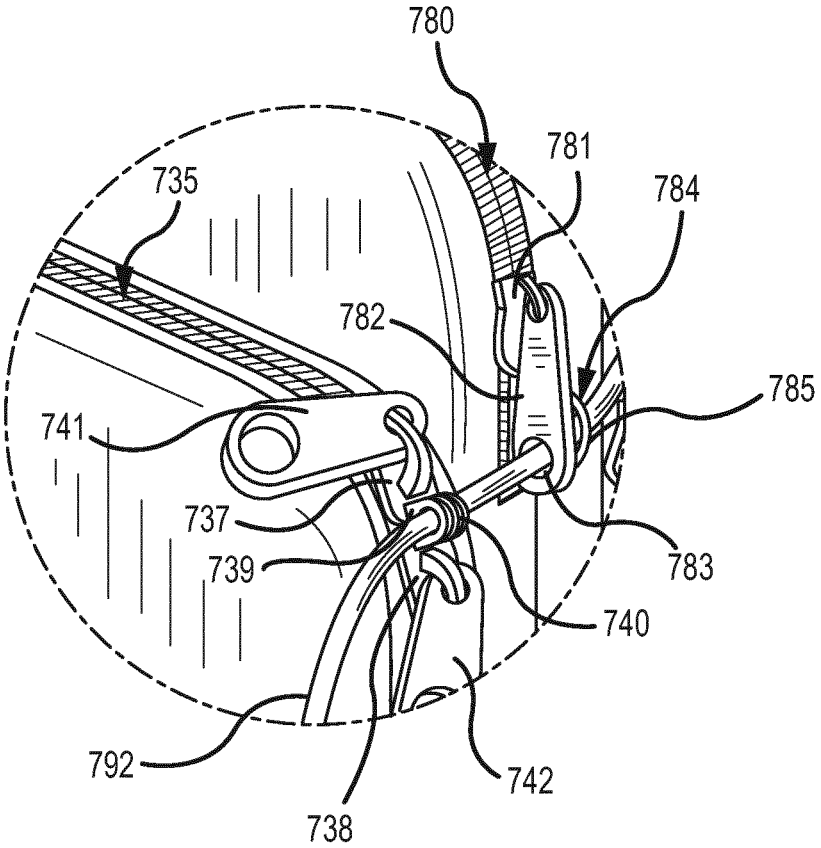

In operation, and with reference to FIG. 10A, the cable 792 may initially be retracted within a cavity 721 (e.g., a cavity, a recess, a pocket, etc.) of the luggage case 800 or a sleeve 722 (described below) defining the cavity 721. In this retracted configuration, the front pocket compartment 713 and the top pocket compartment 714 may be unsecured, and a user may thus gain unfettered access to the front and top pocket compartments 713, 714 by sliding the respective zipper sliders 737, 738, 781 along the respective zipper tapes or tracks. With reference to FIGS. 10B and 100, the cable 792 may be positioned through the zipper slider apertures 739, 740 associated with the front pocket compartment 713. The cable 792 may further be positioned through the top zipper slider aperture and/or the top zipper pull tab hasp 783, and also through the fixed securing element 784. The connector portion 801 of the cable 792 may then be received in the securing recess or receiving hole 753 of the locking device 745, as described above with reference to FIGS. 8A through 8C. In this configuration, a single cable 792 may be used to secure both the front pocket compartment 713 and the top pocket compartment 714 by restricting the zipper closure mechanisms 735, 780, or the single cable 792 may alternatively be used to secure one or the other of the front pocket compartment 713 and the top pocket compartment 714.

Additionally, it is contemplated that the cable 792 may be used in connection with a dual lock system 724 to secure a single compartment 714 with a single zipper slider 781 and a fixed securing element 784.

With reference back to FIGS. 8A and 8B, the cable 792 may be extendible from and retractable into a cavity 721 formed in the luggage case 700 and defined by a sleeve 722 positioned on the outer side or inner side of the luggage case 700. In some cases, the sleeve 722 may be on the front side of the luggage case 700, and may be positioned on a portion of the front pocket compartment 713 or adjacent thereto. The sleeve 722 provides storage for the cable 792 when not in use. At least a portion of the cable 792 may be biased or retracted into the cavity 721 by an automatic retracting mechanism, or may be manually retracted within the sleeve 722 by the user.

Figure 11A:
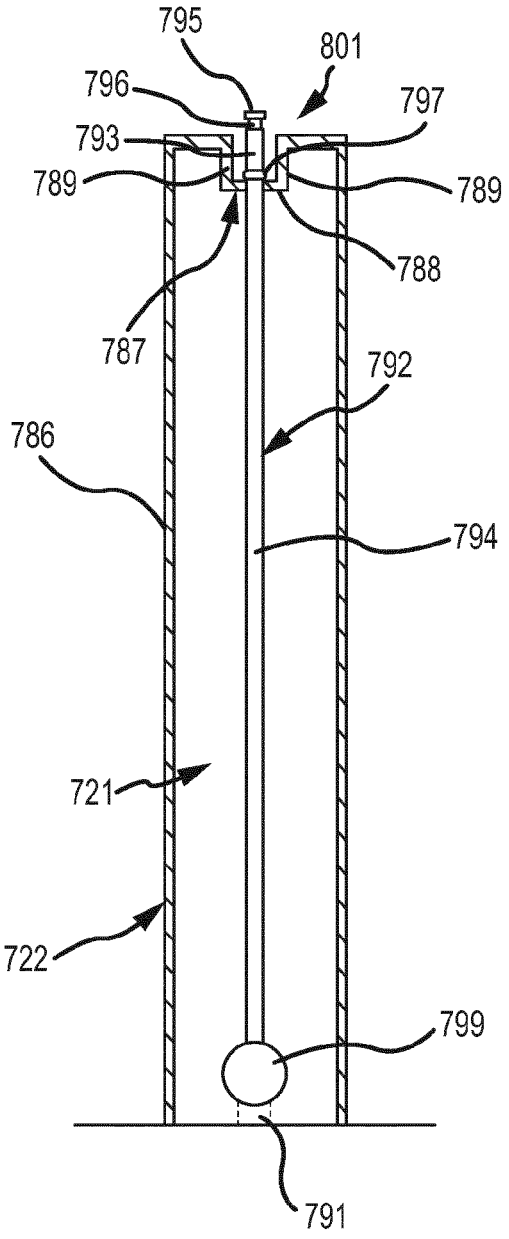
FIGS. 11A and 11B show section views of a sleeve and a cable of the luggage case shown in FIG. 7.
Figure 11B:
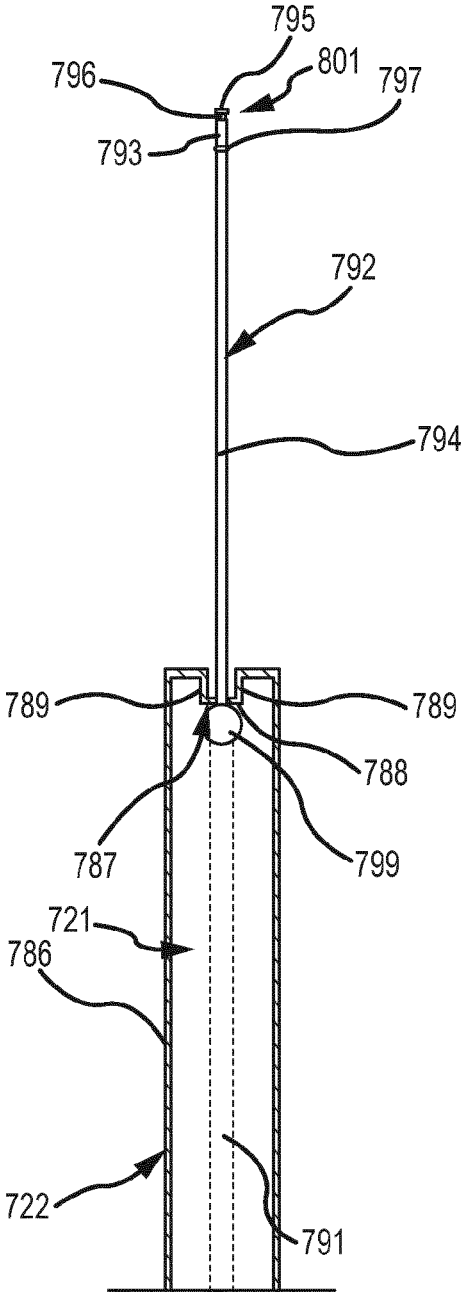

With reference to FIGS. 11A and 11B, an example of a sleeve 722 and cavity 721 structure is shown, and includes at least two sidewalls 789 defining the cavity 721 into which at least a portion of the cable 792 is retracted or manually positioned and stored. A cable guide 786 may be formed by the sidewalls 789, or may be a separate structure from the sidewalls 789 but positioned therebetween, and may provide relatively smooth extraction and retraction. The cable guide 786 may be, for example, an injection molded plastic structure, although in other examples it may be fabric, metal, wood, and so forth. The cable guide 786 may be coupled to the sleeve 722 by, for example, stitching, adhesive, rivets, and so forth. A retaining structure 787 is operably associated with the sleeve 722 or cable guide 786, and helps keep the cable 792 from being fully removed from the luggage case 700. In one example, for instance in FIGS. 9A through 9C, the retaining structure 787 is positioned in an upper portion of the cavity 721. The cable 792 passes through the retaining structure 787 as it is extracted from and retracted into the cable guide 786 or sleeve 722. Further structure and function of the cable guide 786 and retaining structure 787 is described below.

The cable 792 includes opposing ends and a mid-section between the opposing ends. One end 799 of the cable may define an anchor, and the opposing end 793 may be a free end forming a connector structure 801. The cable connector 801 is a structure that can be releasably engaged by the locking device 745, and in one example includes a terminal head 795, an annular groove adjacent the head and forming a neck 796, and a base rim 797. In general the neck 796 may have a diameter smaller than the cable head 795, and both may separately define a generally cylindrical shape. In some examples, the cable head 795 may be bulbous (e.g., may be defined at least in part by a rounded or arc-shaped portion), whereas in other examples, the cable head 795 is not bulbous but rather is relatively flat.

The cable 792 is slidably received through the cable guide 786, and the end 799 is configured to engage the cable guide, to thus anchor the end 799 to the luggage case and keep the cable from being pulled entirely through the cable guide and removed from the luggage case. The end 799 is formed of a structure that has a larger cross section diameter than the diameter of the cable 792. In the example shown in FIGS. 11A and 11B, the end 799 forms an anchor structure that is spherical or bulbous in shape. The cable 792 may be shaped and sized so that it can be received through one or more zipper slider apertures 739, 740 and/or through one or more zipper pull tab hasps or apertures 783. For example, if the corresponding zipper slider apertures 739, 740 or zipper pull tab hasps or apertures 783 are sized such that they include a receiving portion that is approximately 8 mm in diameter (or other relevant dimension if the cable 792 is not cylindrically shaped), the cable 792 may be sized to be approximately half the diameter of the corresponding zipper slider apertures 739, 740 or zipper pull tab hasps or apertures 783. In this manner, the cable 792 may not need to be exactly aligned with and inserted at a particular angle relative to the corresponding zipper slider apertures 739, 740 or zipper pull tab hasps or apertures 783 when a user threads the cable through the corresponding zipper slider apertures 739, 740 or zipper pull tab hasps or apertures 783.

The cable 792 may be a metal wire or multiple metal wires in some examples, and may have a sheath of plastic, fabric, or other material surrounding it. The cable 792 may alternatively be plastic or another suitable material, or a combination thereof.

The apertures on each zipper slider 727, 728, 737, 738, 781 or pull tab 731, 732, 741, 782 may be sized to be approximately twice the diameter as the cable 792. For example, the apertures may be sized to have a diameter (or if the apertures are not circular, a different dimension) that is approximately 8 mm in some examples, and the cable 792 may be sized to have a head 795 that is approximately 4 mm in diameter and the intermediate length 794 of the cable 792 is approximately 3 mm in diameter (assuming a cylindrical shaped cable). When any two or more sliders 727, 728, 737, 738, 781 are adjacent to, and preferably when they abut, one another, the respective apertures at least partially overlap and are generally at least partially co-extensive with each other, thereby allowing the cable 792 to be placed therethrough.

The retaining structure 787 of a cable guide 786 (or, alternatively, of a sleeve 722), as shown in FIGS. 11A and 11B includes a collar 788 forming an aperture through which at least some of the cable 792 may pass, but through which the anchored end 799 may not pass. This helps retain the cable 792 in the cable guide 786 of the sleeve 722 by capturing the anchor end 799 in the collar 788. In one example, the aperture formed by the collar 788 may have a dimension sufficiently large to allow the mid-section 794 of the cable 792 to be extended from and retracted into the sleeve 722 and/or cable guide 786, but may be sufficiently small to prevent the base rim 797 of the cable connector 801 from passing through the collar 788. The retaining structure 787 may include an offset aperture positioned to receive a portion of the cable connector 801 within the cable guide 786 or sleeve 722 but still exterior to the retaining structure 787. A portion of the cable connector 801 may extend beyond the top of the cable guide 786 or sleeve 722 to allow a user to grasp the cable connector 801, yet keep the cable connector 801 in a low profile position when stored to reduce the risk of catching on other objects during handling.

The smooth exterior shape of the cable anchor end 799, in some examples, facilitates ease of movement of the cable anchor end 799 within the cable guide 786 or sleeve 722 during retraction and extension. The cable guide 786 may be resistant to wear by the repeated movement of the cable anchor end 799 and cable 792 within the sleeve 722. It is contemplated that the retaining structure 787 may take the form of a collar 788, as noted above, secured at the top of the sleeve 722 and without a cable guide 786 structure positioned within the sleeve 722. It is further contemplated that the cable guide 786 may be positioned on the exterior of the luggage case 700 and not inside the sleeve 722.

In some examples, the retaining structure 787 to secure the cable 792 in the sleeve 722 may additionally include an elastic coupler 791 (shown in dashed lines in FIGS. 11A and 11B) attached to the cable end 799. The elastic coupler 791 may, for example, help automatically bias or retract the cable 792 at least partially into the sleeve 722 or cable guide 786 when not in use. Many different embodiments are possible for the coupler 791. For example, the coupler 791 may be a resiliently coiled plastic spring or constant force spring. Additionally, the cable 792 itself may be a coiled cable that extends and resiliently retracts into the sleeve or through the cable guide.

Figure 12A:
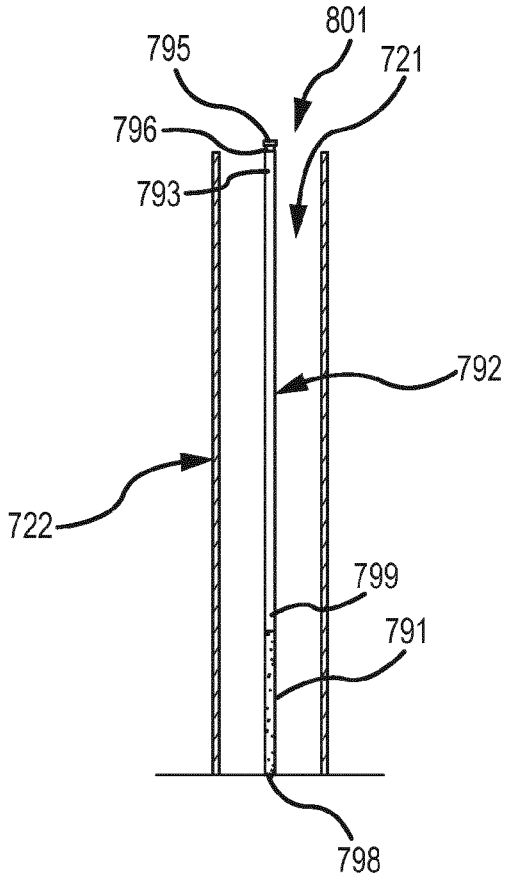
FIGS. 12A and 12B show section views of a sleeve and a cable of the luggage case shown in FIG. 7.
Figure 12B:
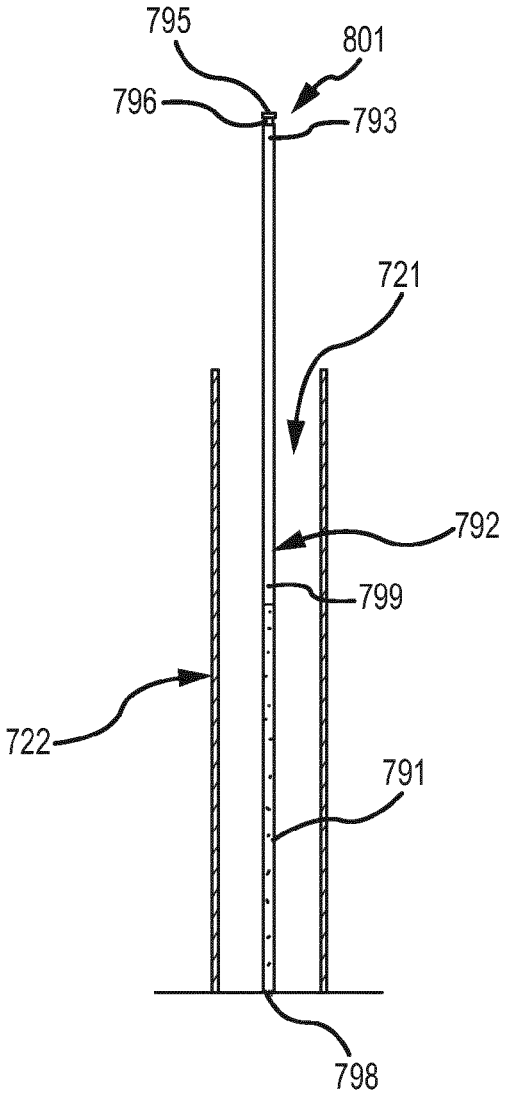

With reference to FIGS. 12A and 12B, no cable guide 786 may be used in some examples, but rather the fabric forming the front pocket 713 and/or the sleeve 722 may define a cavity 721 for receiving the cable 792. The cable 792 may be coupled to the luggage case 700, such as the structure in or near the front pocket compartment 713 via a resiliently extendable coupler 791, such as elastic. The resilient coupler 791 may be anchored to a seam 798 at the bottom of the sleeve 722, to a sidewall 789, or elsewhere on the luggage case 700 as may be suitable. The resilient coupler 791 may also be attached to the end 799 of the cable 792. A coupler 791 made of a combination of fabric and a resilient material may provide adequate strength to resist being tensioned to failure. Alternatively, the coupler 791 may also be a coiled metal structure, such as a spring, or another suitable material. As mentioned above, in some cases, a cable guide 786 may be used in conjunction with an elastic coupler 791. In general, many different types of sleeves 722, cables 792, and cable guides 786 may be used in the dual locking system 724 described herein.

Figure 13:
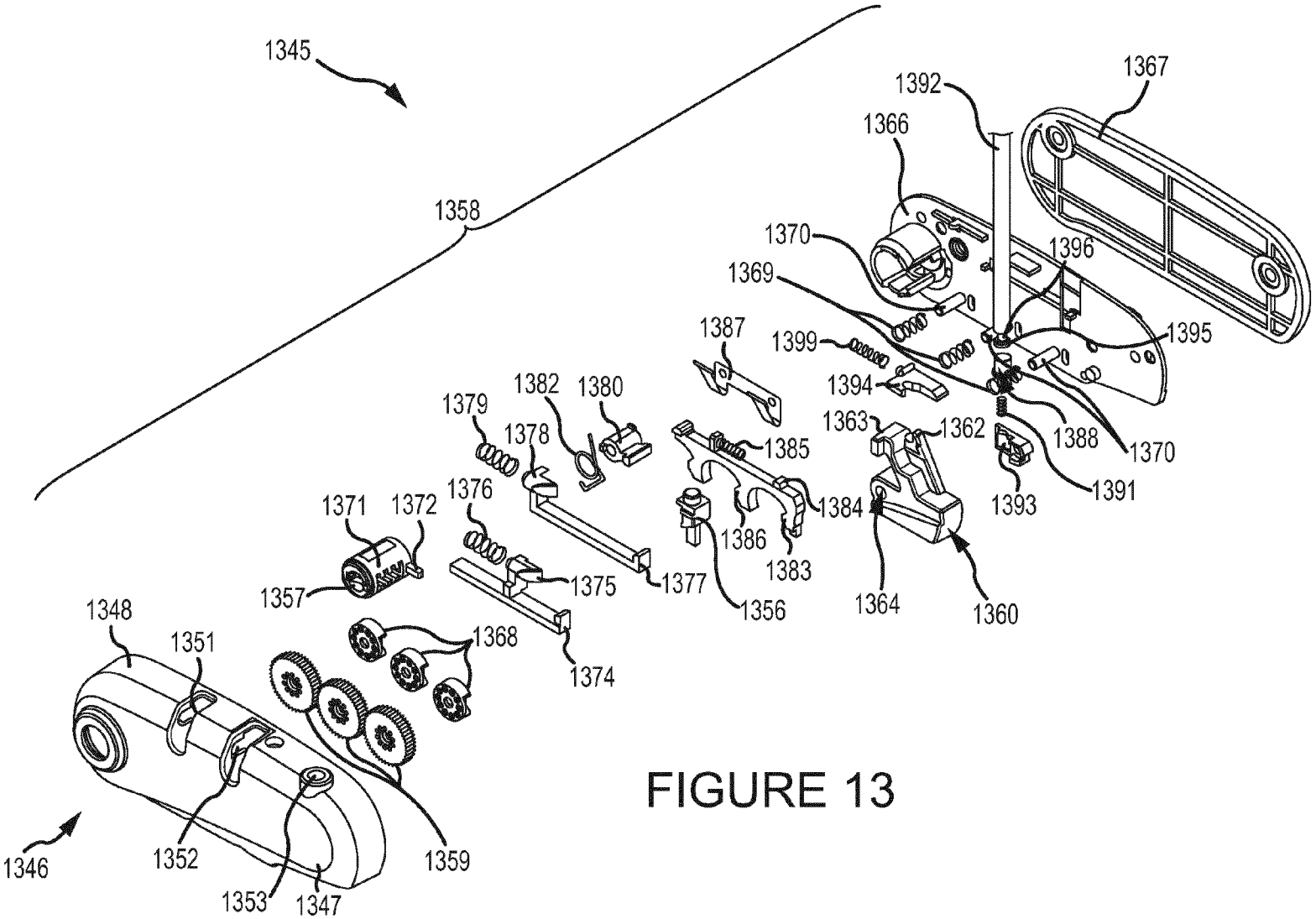
FIG. 13 shows an exploded perspective view of the locking device of the dual lock system shown in FIGS. 7 through 100.
Figure 14:
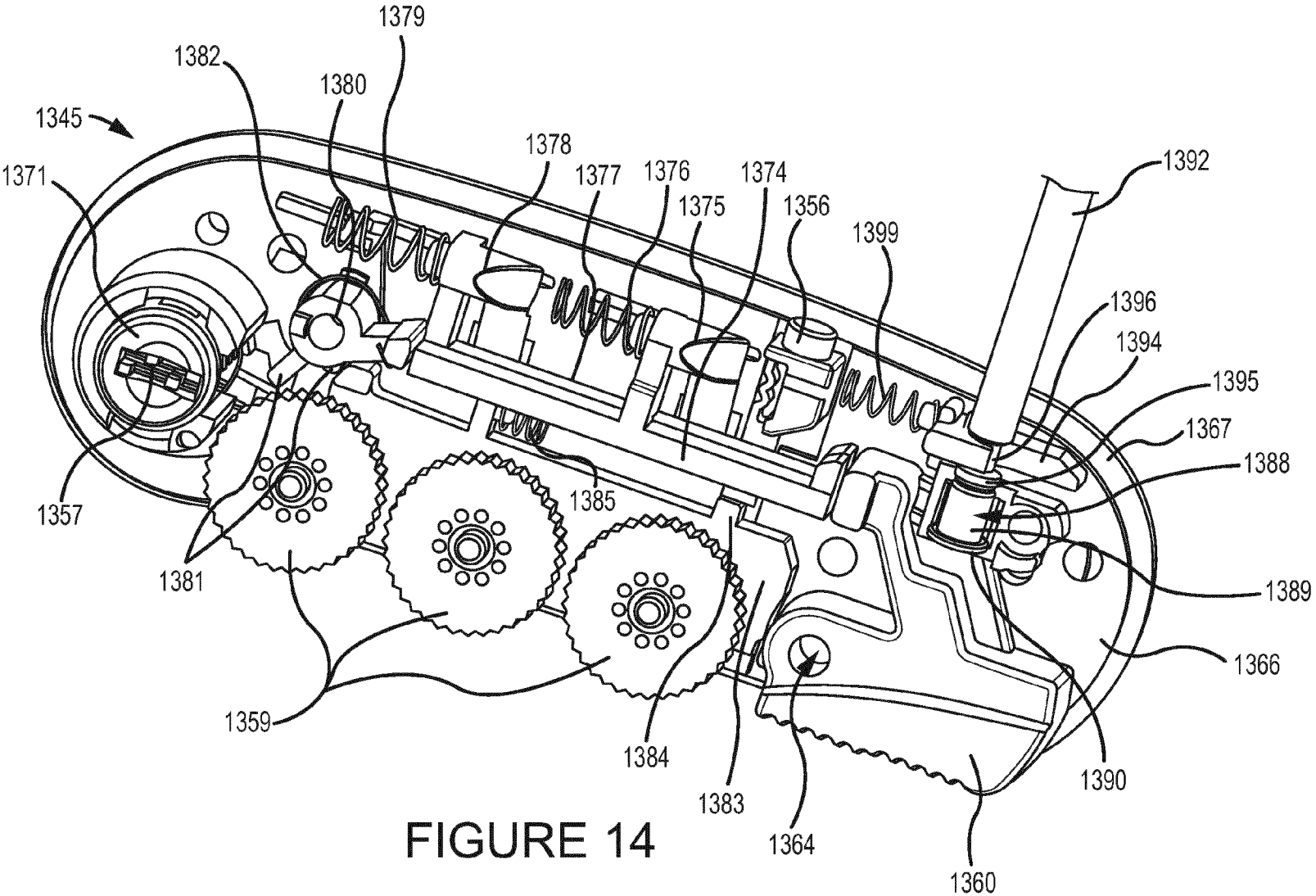
FIG. 14 shows a front perspective, partially cutaway view of the locking device of the dual lock system shown in FIGS. 7 through 10C.
Figure 15:
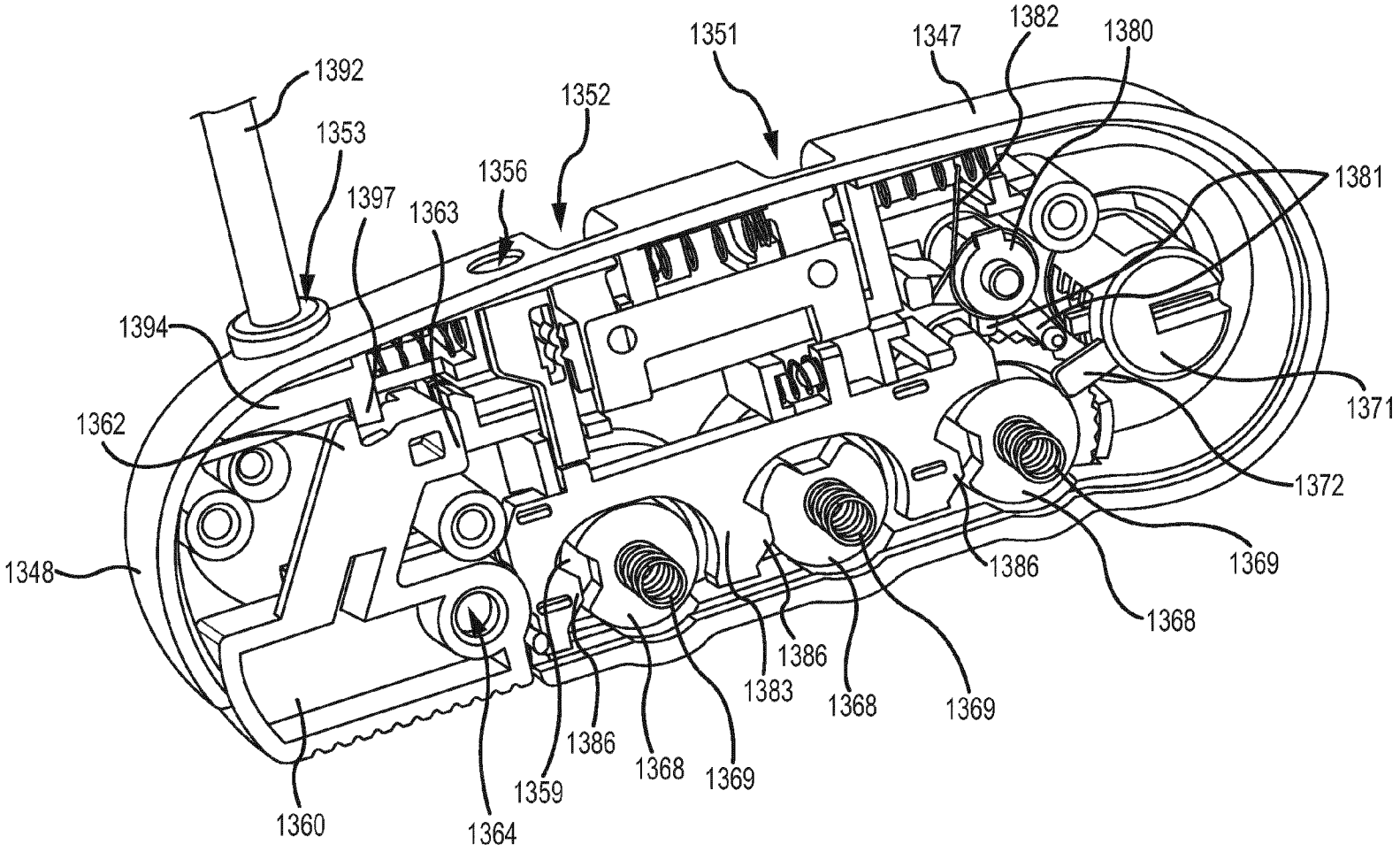
FIG. 15 shows a rear perspective, partially cutaway view of the dual locking device of the dual lock system shown in FIGS. 7 through 10C.

The locking device 745 described herein acts to secure the zipper sliders 727, 728 of the main luggage compartment 713, and/or as inhibit the separation of the zipper sliders 737, 738, 781 of the front and/or top pocket compartments 713, 714. In order to do this, the locking device 745 may selectively and securely receive the pull tabs 731, 732 of at least the two zipper sliders 727, 728 from the first zipper closure mechanism 725, and the connector portion 801 of the cable 792 described earlier. FIGS. 13-15 show one example of a locking device 1345 configured for this purpose. The locking device 1345 may be used for the dual lock system 724 shown and described with reference to FIGS. 7 through 10C. Of course other examples of locking devices may be used for the dual lock systems 724 shown and described herein, and FIGS. 13 through 15 are merely illustrative of one such example. As above, the locking device 1345 may include a housing 1346. The housing 1346 may include a face plate 1347 that defines one or more securing recesses or receiving holes 1351, 1352, 1353. For example, the face plate 1347 may define first and second securing recesses or receiving holes 1351, 1352 sized to receive the first and second zipper pull tabs 731, 732, described above. A third securing recess or receiving hole 1353 may also be defined by the face plate 1347, and may be sized to receive the head 1395 of the connector portion of the cable 1392. The third securing recess or receiving hole 1353 may be circular or otherwise shaped to match the generally circular or other shape of a perimeter of the connector portion of the cable 1392. The face plate 1347 may also define openings for a tumbler lock 1371 and one or more combination dials 1359. These recesses and openings may also be formed on other components of the housing 1346.

With reference to FIG. 13, each combination dial 1359 may have an associated notched wheel 1368 to which it is coupled. Each combination dial 1359 and associated notched wheel 1368 may be rotatably coupled to an axle post 1370 extending from an intermediate plate 1366 of the locking device 1345. A spring 1369 axially mounted on each axle post 1370 acts on each of the respective notched wheels 1368 to bias it against the back side of the combination dial 1359. Detents found between the engaging surfaces of the notched wheel 1368 and the combination dial 1359 allow the notched wheel 1368 and combination dial 1359 to be keyed together and rotate in concert about the axle post 1370. The detents in one example are bumps or protrusions formed on the notched wheel 1368 and corresponding detents or recesses formed on the back of the combination dial 1359; in another example, and with reference to FIG. 13, bumps or protrusions are formed on the combination dial 1359 and the detents or recesses are formed on the notched wheel 1368. All of the notched wheels 1368 may be configured to selectively engage and disengage a combination slider 1383.

When the combination slider 1383 is in an unlocked position, it may cause a cam actuator 1380 to rotate into an unlocked position as well, thereby allowing first and second slider bars 1374, 1377 to slide laterally within the lock device 1345 when actuated. The cam actuator 1380 may include one or more dogs 1381 that induce rotation of the cam actuator 1380 when a force is applied thereto. For example, the cam actuator 1380 may include one dog 1381 operable to translate a lateral force provided by the combination slider 1383 and the cam actuator 1380 may include a second dog 1381 to translate a rotational force provided by the protrusion 1372 of the tumbler lock 1371, as described in more detail below.

With reference to FIG. 15, when at least one combination dial 1359 is not turned to the appropriate combination code, at least one protrusion 1386 of the combination slider 1359 may not be received in the associated notched wheel 1368, and the combination slider 1383 will remain in a locked position. When the combination slider 1383 is in a locked position, the cam actuator 1380 may remain in a locked position, thereby preventing the first and second slider bars 1374, 1377 from sliding laterally within the lock device 1345 due to the engagement of the hammer portion of the cam actuator 1380 and the ends of the slider bars 1374, 1377.

When the combination dials 1359 associated with all of the notched wheels 1368 are turned to the appropriate combination code, all of the protrusions 1386 in the combination slider 1383 may be received within respective notches in each of the notched wheels 1368, which may cause the combination slider 1383 to move to an unlocked position. A spring 1385 may bias the combination slider 1383 towards its unlocked position, but that bias may be overcome by the notched wheels 1386 when the combination dials 1359 are not turned to the proper combination code. The spring 1385 coupled to the combination slider 1383 may provide a greater biasing force than the spring 1382 coupled to the cam actuator 1380 so that the combination slider 1383 can overcome the restoring force of the spring 1382 and cause the cam actuator 1380 to rotate due to the force exerted on the cam actuator dog 1381 by the combination slider 1383. When the combination slider 1383 slides into its unlocked position, the combination slider 1383 may engage one of the dogs 1381 of the cam actuator 1380, thereby causing the cam actuator 1380 to rotate, which in turn allows the first and second slider bars 1374, 1377 to slide laterally within the lock device 1345 (when actuated by the release member 1360).

Many locking devices 1345 have a second lock actuation mechanism 1371 to allow security agencies to open the luggage case 100, 700 as part of a security check process. In many circumstances, a tumbler lock 1371, actuated by a key, is utilized for this purpose. The tumbler lock 1371 may, similar to the combination slider 1383, cause engagement with a dog 1381 of the cam actuator 1380 when the key is turned and cause the cam actuator 1380 to rotate into an unlocked position. The tumbler lock 1371 may include a protrusion 1372 configured to engage the dog 1381 and thereby cause the cam actuator 1380 to rotate. In some cases, the tumbler lock 1381 may be configured to accept a skeleton key, a master key, and/or may be configured to accept a key provided to owners or users of a luggage case 100, 700. The protrusion 1372 of the tumbler lock 1371 may act to "override" the lack of the proper combination being present on the combination dials 1359, but may nonetheless not cause the cam actuator 1380 to rotate so far that the combination slider 1383 is prevented from sliding into an unlocked position should the correct combination be present on the combination dials 1359.

With reference to FIGS. 13 through 15, the cam actuator 1380 may be coupled to a spring 1382 so that the cam actuator 1380 is biased in its locked position unless engaged by either the protrusion 1372 of the tumbler lock 1371 or the combination slider 1383. The cam actuator 1380 may be rotatably secured to the intermediate plate 1366 of the locking device 1345.

First and second sliding bars 1374, 1377 may each include a respective shaft 1375, 1378 configured to engage a zipper pull tab aperture or hasp (e.g. hasps 733, 744 described above) when inserted into the respective securing recess or receiving hole 1351, 1352 of the locking device 1345. This structure is described in detail below, and with respect to FIGS. 13 through 15. Each shaft 1375, 1378 may include a top cammed surface to allow the insertion of the zipper pull tab to push away the respective spring-loaded shaft 1374, 1377 and return to be secured through the aperture or hasp of the pull tab, and a relatively flat or non-cammed bottom portion to retain the zipper pull tab aperture or hasp once inserted. With reference to FIGS. 14 and 15, each of the first and second sliding bars 1374, 1377 may be biased to a retaining position by a respective spring 1379, 1385 (thereby retaining the inserted zipper pull tab apertures or hasps, if any), but engagement of a release member 1360 may cause the first and second sliding bars 1374, 1377 to slide laterally within the locking device 1345, when permitted by the cam actuator 1380, in order to release any inserted zipper pull tabs.

With reference to FIGS. 13 and 15, a biasing plate 1387 may bias any inserted zipper pull tabs outward when released by the shafts 1375, 1378 of the first and second slider bars 1374, 1377. The biasing plate 1387 may include a planar portion and two arm portions extending therefrom. The planar portion may be coupled to the intermediate plate 1366, and the arm portions may load zipper pull tabs, when inserted, such that when the shafts 1375, 1378 of the first and second slider bars 1374, 1377 are slid out from the zipper pull tabs, the arm portions eject the zipper pull tabs out from the first and second securing recesses or receiving holes 1351, 1352.

With reference to FIG. 14, the release member may be coupled to the intermediate plate 1366 of the locking device 1345, and may pivot about a pivot point 1364 via a coupling member, such as a screw or rivet. The release member 1360 may include a ribbed portion for engagement of a user's finger, may include a hammer-like portion 1363 for engagement with the first and second slider bars 1374, 1377, and with reference to FIGS. 13 and 15, the release member 1360 may also include a ridge 1362 for engagement with a flange 1397 of a catch or securing member 1394. The ridge 1362 may be proximate the hammer-like portion 1363, but may extend above the top-most surface of the hammer-like portion 1363 in order to slidingly engage the flange 1397 of the catch or securing member 1394, as described in more detail below.

With reference to FIGS. 13 through 15, the locking device 1345 may also include a code reset button 1356, which may be configured to help reset the combination code of the combination dials 1359 and notched wheels 1368. When the code reset button 1356 is depressed after the combination dials 1359 have been turned to the correct combination code (with reference to FIG. 15, the code reset button 1356 is prevented from being depressed when the combination dials 1359 are not turned to the correct combination dial), the code reset button 1356 may engage the side of a stub 1384 on the top of the combination slider 1383 in order to prevent the combination slider 1383 from moving into its unlocked position as the combination dials 1359 are rotated relative to their respective notched wheels 1368 in order to set a new combination for operating the locking device 1345. With reference to FIG. 13, such relative rotation may decouple (e.g., overcome the biasing by springs 1369) the combination dials 1359 from the notched wheels 1368 and may cause the protrusions on the bottom of the combination dials 1359 to move into different detents or recesses in each of the notched wheels 1368, thereby re-keying the combination dials 1359. Once the new combination has been set, the engagement member 1360 may be actuated, which may cause the first and second slider bars 1374, 1377 to slide laterally, which in turn causes the code reset button 1356 to return to its non-activated position as a result of the sloped surfaces of the first and second slider bars 1374, 1377 engaging the corresponding sloped surface of the code reset button 1356.

The addition of a third securing recess or receiving hole 1353 for selective securement of the connector end of the cable 1392 within the locking device 1345 enables the locking device 1345 to lock both pull tabs and a cable connector together, or either one separately. With reference to FIGS. 13 through 17C and as mentioned above, the locking mechanism 1345 may include a spring biased catch or securing member 1394 configured to receive the neck 1396 and head 1395 of the cable connector within the locking mechanism 1345. A spring biased-ejection member 1388 biases the cable connector outwards when not secured by the catch or securing member 1394, and a housing 1393 retains the ejection member 1388. The release member 1360 of the locking device 1345, described above, may also include a ridge 1362 that selectively disengages the catch or securing member 1394 from a locked or secured position.

The catch or securing member 1394 may be generally planar and have a J-shaped hook portion 1398. The hook portion 1398 may be shaped and sized to receive the neck 1396 of the cable 1392 when it is positioned within the third securing recess or receiving hole 1353 of the locking device 1345. More specifically, the hook portion 1398 of the catch or securing member 1394 may have a cutaway diameter that is greater than the diameter of the cable neck 1396 but less than the diameter of the cable head 1395. In this way, the J-shaped hook portion 1398 retains the cable head 1395 in the recess 1353 of the locking device 1345 to keep it from being released.

Figure 17A:
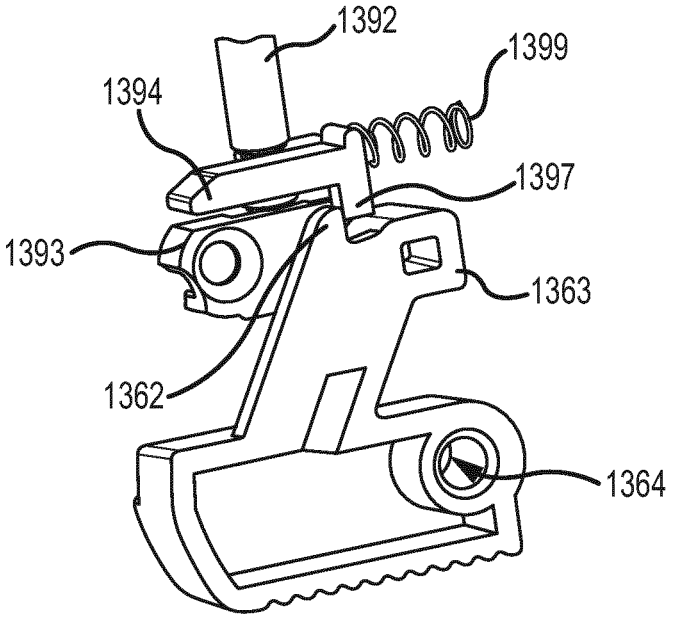
FIGS. 17A through 17C show rear perspective views of the components of the locking device shown in FIGS. 16A through 16C, respectively.
Figure 17B:
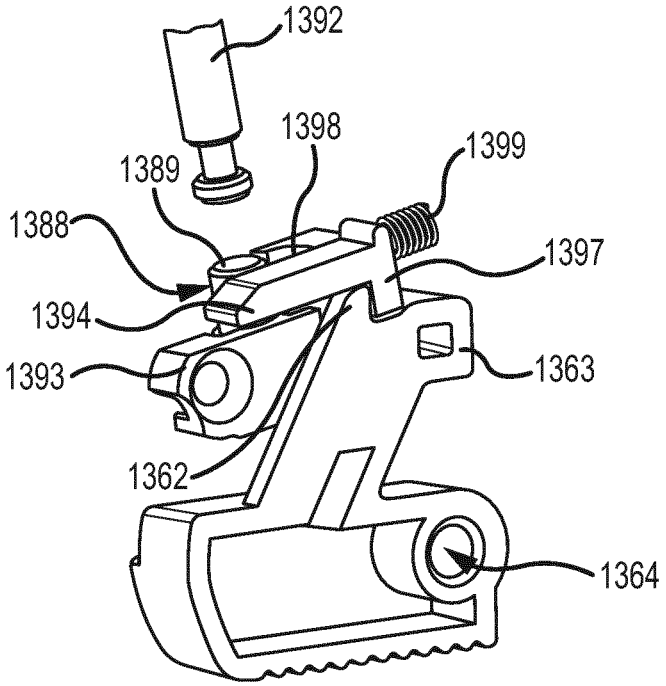

The catch or securing member 1394 may also include a post configured to receive a spring 1399 to bias the catch or securing member 1394 into a locked or secured position, thereby retaining the neck 1396 and head 1395 of the cable 1392 or the ejection member 1388 within the hook portion 1398 when the release member 1360 is not actuated. The post may extend laterally away from the generally planar portion of the catch or securing member 1394, and, with reference to FIG. 15, the spring 1399 may be biased against a wall of the faceplate 1347 of the locking device 1345. The catch or securing member 1394 may also include a flange 1397 that extends below the generally planar surface of the release member 1394 at an angle normal to the hook portion 1398, and may be shaped and sized to be engaged by the ridge portion 1362 of the release member 1360. With reference to FIGS. 17A and 17B, the ridge portion 1362 of the release member 1360 may slidingly engage the flange 1397 of the catch or securing member 1394 and, in so doing, may cause the catch or securing member 1394 to slide laterally within the housing 1346 of the lock device 1345 and disengage from the neck 1396 of the cable 1392. This releases the cable head 1395, thereby allowing the head 1395 to be ejected by the ejection member 1388. The flange 1397 of the catch or securing member 1394 may be actuated by the ridge portion 1362 of the release member 1360, for example, when the release member 1360 pivots within the housing 1346 when the combination dials 1359 show the correct combination code and/or when the tumbler lock 1371 is actuated.

With reference to FIGS. 13 and 16A through 17C, the locking device 1345 may include the ejection member 1388, which may define a cylindrical body 1389 with a bottom flanged rim 1390. The cylindrical body 1389 may have approximately the same diameter as the head 1395 of the cable 1392 in some cases. The cylindrical body 1389 of the ejection member 1388 may also have a diameter that is approximately the same size as or slightly smaller than the cutaway diameter of the hook portion 1398 of the catch or securing member 1394 in some but not all cases. The bottom flanged rim 1390 may have a diameter that is greater than a clearance of the ejection member housing 1393 (described below) and may also have a diameter that is greater than a portion of the cutaway diameter of the hook portion 1398 of the catch or securing member 1394.

With reference still to FIGS. 13 and 16A through 17C, an ejection member housing 1393 may enclose at least a portion of the ejection member 1388. The ejection member housing 1393 may include a generally planar plate 1393, and may also include a portion of the faceplate 1347 of the locking device 1345. The generally planar plate 1393 may be coupled to the faceplate 1347 of the locking device 1345 via one or more fasteners, such as screws. The generally planar plate of the housing 1393 and the faceplate 1347 may together define a collar that allows the cylindrical body 1389 of the ejection member 1388 to selectively extend and retract within the ejection member housing 1393, but prevents the bottom flanged rim 1390 of the ejection member 1388 from being able to extend from the ejection member housing 1393. The cylindrical body 1389 of the ejection member 1388 may be biased up through the collar of the ejection member housing 1393 by a biasing spring 1391. The spring 1391 may eject the cable head 1395 and neck 1396 from being secured within the locking device 1345 when the release member 1360 is actuated after the appropriate combination or key has been entered to the locking device 1345. When the release member 1360 is not actuated and the cable head 1395 and neck 1396 are received within the locking device 1345, the ejection member 1388 may be received within the ejection member housing 1393, and the spring 1391 may load the ejection member 1388, ready to eject the cable head 1395 and neck 1396 when the release member 1360 is eventually actuated.

Figure 16A:
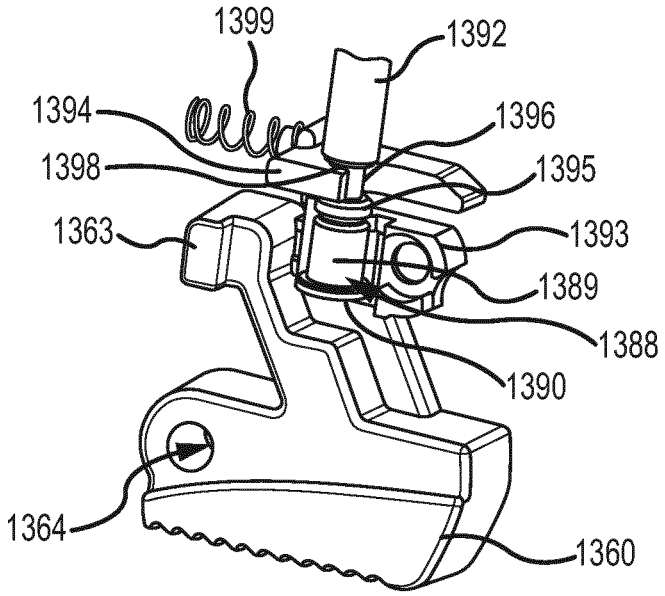
FIGS. 16A through 16C show front perspective views of some of the components of the locking device of FIG. 13 through 15 in operation.
Figure 16B:
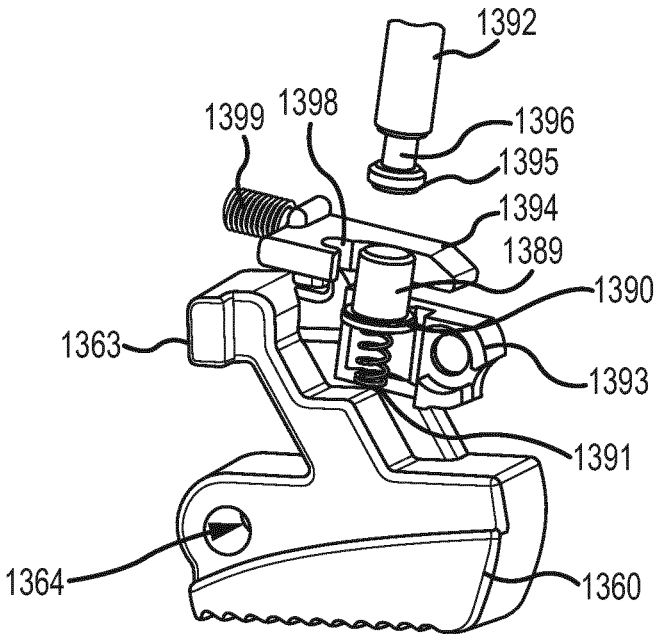

With reference to FIGS. 16A through 17C, the operation of the locking device 1345 as it relates to selectively securing the cable 1392 will now be described. With reference to FIGS. 16A and 17A, when the release member 1360 is not actuated, the cable head 1395 is secured within the locking device 1345 by the engagement of the hook portion 1398 of the catch 1394 engaging the neck 1396 of the cable 1392. With reference to FIGS. 16B and 17B, when the release member 1360 is actuated, the cable neck 1396 and the cable head 1395 may be released from the locking device 1345. More specifically, for example, the release member 1360 may be actuated by a user pressing the ridged portion of the release member 1360, which in turn causes the release member 1360 to pivot relative the pivot point 1364 around which the release member 1360 is coupled to the intermediate plate 1366 and/or the faceplate 1347 of the locking device 1345. When the release member 1360 pivots, the ridge 1362 of the release member 1360 may travel in an arc relative to the pivot point 1364 of the release member 1360, and, in so doing, may engage the flange 1397 of the catch or securing member 1394, thereby causing the catch or securing member 1394 to slide laterally and retract away from the cable neck 1396 and cable head 1395. Once the cable neck 1396 and cable head 1395 can clear at least a portion of the hook portion 1398 of the catch or securing member 1394, the cable 1392 may be ejected by the upward force of the spring-loaded ejection member 1388 on the head 1395 of the cable connector.

Figure 16C:
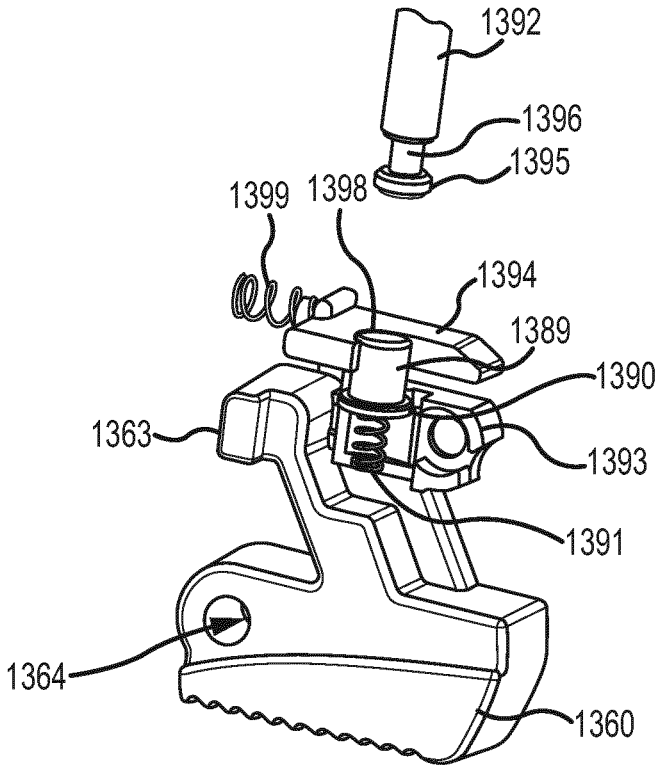
Figure 17C:
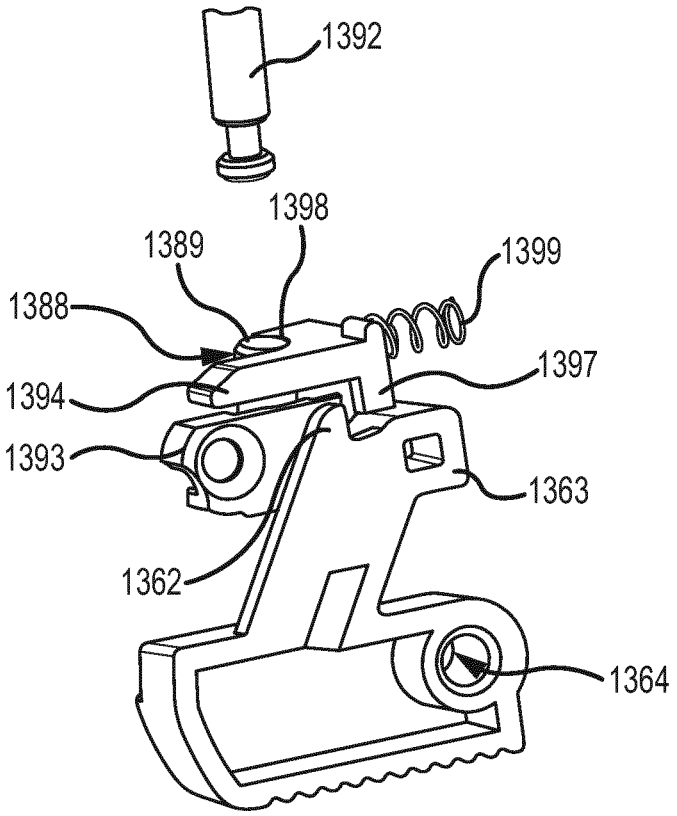

With reference to FIGS. 16C and 17C, after the cable 1392 is released from the locking device 1345 and the user releases the release member 1360, the catch or securing member 1394 may again slide laterally under a bias force of a spring 1399 until it engages the extended cylindrical body 1389 of the ejection member 1388. However, because the diameter of cylindrical body 1389 of the ejection member 1388 is approximately the same as the diameter of the cable head 1395 and is larger than the diameter of the cable neck 1396, the catch or securing member 1394 remains slightly displaced laterally from its position in FIGS. 16A and 17A, thus creating a gap between the flange 1397 of the catch or securing member 1394 and the ridge 1362 of the release member 1360. In this position, the catch or securing member 1394 is ready for insertion of the cable head 1395 to be locked. Returning now to FIGS. 16A through 17A, when the cable head 1395 is again positioned proximate the third securing recess or receiving hole 1353 of the locking device 1345, the cable head 1395 may engage the cylindrical body 1389 of the ejection member 1388 (which two may have approximately the same diameter), and the force of insertion of the cable head 1395 may load the ejection member spring 1391 as the ejection member 1388 retracts into the ejection member housing 1393. Once the cable neck 1396 clears the bottom of the catch or securing member 1394, the catch or securing 1394 member may continue to slide laterally until it is again in the position shown in FIGS. 16A and 17A, which is snugly around the neck 1396 of the cable 1392. Because the cylindrical body 1389 of the ejection member 1388 holds the catch or securing member 1394 laterally displaced up to and even as the cable head 1395 is inserted into the third securing recess or receiving hole 1353, the cable head 1395 may be inserted into the locking device 1345 without the need for a top cammed surface on the catch or securing member 1394.

With reference now back to FIGS. 14 and 15, the locking device 1345 and locking mechanism 1358 release the first and second pull tabs and the cable connector from the locking device 1345 when the combination dials 1359 show the correct combination code and/or when the tumbler lock 1371 is actuated. In other examples, however, two or more release members (not shown) may selectively release the cable connector and the pull tabs separately, or a single release member (not shown), actuated in two different ways or at different levels of actuation (e.g., first and second stages of displacement), may selectively release the cable connector and the pull tabs separately.

The dual lock systems 124, 724 described herein may allow a single locking device 145, 745, 1345 to be used for zipper pull tabs of one or more compartments of a luggage case in connection with a cable operably securing zipper sliders of another one or more compartments of the luggage case. In this manner, a user of the luggage case may not need to have multiple locks, combinations, keys, and the like in order to access two or more different compartments of a luggage case, including in luggage cases where the zipper sliders and pull tabs may not necessarily be positionable proximate one another. Furthermore, with reference to FIGS. 13 through 17C, the locking mechanism of one example of a locking device may allow for a single movement of a release member to release both the zipper pull tabs and the cable secured within the single locking device, and may therefore facilitate ease of operation by the user, although as mentioned, in other examples, one or more release members may be used, or a single release member may be actuated in two or more different fashions.

The apparatus and associated methods in accordance with the locking system have been described with reference to particular embodiments thereof in order to illustrate the principles of the invention. The above description is thus by way of illustration and not by way of limitation. Various modifications and alterations to the described embodiments will be apparent to those skilled in the art in view of the teachings herein. Those skilled in the art may, for example, be able to devise numerous systems, arrangements and methods which, although not explicitly shown or described herein, embody the principles described herein and are thus within the spirit and scope of this disclosure. Accordingly, it is intended that all such alterations, variations, and modifications of the disclosed embodiments are within the scope of this disclosure as defined by the appended claims.

Although FIGS. 1 through 17C show dual lock systems on an upright-type luggage case, similar dual lock systems 124, 724 may be used on hard shell (e.g. injection molded plastic), semi-rigid (e.g. nylon), hybrid (partially hard shell and partially soft sided) or even entirely soft-sided luggage cases or bags, including duffle bags and backpacks. Furthermore, although reference is made herein to a various compartments or pockets (e.g., front pocket compartment, top pocket compartment, main compartment, front compartment, first compartment, etc.), it will be understood that these references are merely exemplary and not limiting.

The dual lock systems 124, 724 may be used on carry-on type luggage cases, or checked luggage cases. Various features of the dual lock systems 124, 724 described herein may be combined with other features described herein. For example, the release members shown in FIG. 6A may be combined with the key receptacle shown in FIG. 6C. As another example of a modification, although FIG. 7 through 10C describe a cable for use with a front pocket, the cable may also or alternatively be used to secure a main compartment, or may be used to secure the luggage case to a stationary item, such as a pole or a permanent fixture by looping the cable around a chair leg or arm, for example, before securing the cable end to the locking device As another example of a modification, although the locking device shown and described with reference to FIGS. 13 through 17C may include a release member that releases the first and second zipper pull tabs at the same time as releasing the connector portion of the cable, the locking device may alternatively include one release member that releases the first and second zipper pull tabs, and a second release member that independently releases the connector portion of the cable. Alternatively, a single release member may be used for these functions, but the release member may be engaged in two different directions to accomplish these different functions. In general, many different types of locking devices may be used for the dual lock systems 124, 724 described herein. In general, the teachings of FIGS. 1 through 17C and accompanying text may be applied to any of the examples described herein.

Where appropriate, common reference numbers and words may be used for common structural and method features across the various figures. However, unique reference numbers and words are sometimes used for similar or the same structural or method elements for descriptive purposes. As such, the use of common or different reference numbers or words for similar or the same structural or method elements may or may not imply a similarity or difference beyond that described herein.

In methodologies directly or indirectly set forth herein, various steps and operations are described in one possible order of operation, but those skilled in the art will recognize that the steps and operations may be rearranged, replaced, or eliminated without necessarily departing from the spirit and scope of the disclosed embodiments.

All relative and directional references (e.g., upper, lower, upward, downward, left, right, leftward, rightward, top, bottom, side, above, below, front, middle, back, vertical, horizontal, clockwise, and counterclockwise) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

In some instances, components are described with reference to "ends" having a particular characteristic and/or being connected with another part. However, those skilled in the art will recognize that the disclosed embodiments are not limited to components, which terminate immediately beyond their points of connection with other parts. Thus, the term "end" should be interpreted broadly, in a manner that includes areas adjacent, rearward, forward of, or otherwise near the terminus of a particular element, link, component, part, member or the like.

What is claimed is:

1. An apparatus for selectively securing at least a first zipper closure mechanism and a second zipper closure mechanism of a luggage case, the apparatus comprising:

the first zipper closure mechanism associated with a first zipped opening of the luggage case and the second zipper closure mechanism associated with a second zipped opening of the luggage case;

a lock device coupled to the luggage case; and the lock device includes a lock mechanism operable between a locked and unlocked configuration, at least two securing recesses for releasable receipt of at least a portion of each of the respective first and second zipper closure mechanisms, and at least one release member for actuating the lock mechanism.

2. The apparatus of claim 1, further comprising an elongated cable operably engageable with at least one zipper slider of the second zipper closure mechanism to limit its movement, and at least one of the two securing recesses operable to releasably receive a free end of the cable.

3. The apparatus of claim 2, wherein the elongated cable is operable to engage the at least one zipper slider and limit movement of the at least one zipper slider, and a first of the least two securing recesses operable to releasably receive the free end of the cable.

4. The apparatus of claim 2, wherein the at least one zipper slider includes at least one zipper securing element configured to selectively receive a portion of the elongated cable therethrough, and the zipper securing element is at least one of a hasp or an aperture.

5. The apparatus of claim 2, wherein at least one zipper pull tab is coupled to the at least one zipper slider and the at least one zipper pull tab includes an aperture configured to selectively receive a portion of the elongated cable therethrough.

6. The apparatus of claim 2, wherein the luggage case further comprises a sleeve that defines a cavity, the sleeve is coupled to the luggage case and configured to retractably receive at least a portion of the cable into the cavity, and the cable defines a second end that is opposite the free end and that is anchored in the cavity.

7. The apparatus of claim 6, further comprising an elastic coupler coupled to the cable and operable to resiliently extend at least a portion of the cable out of the cavity and retract at least a portion of the cable into the cavity.

8. The apparatus of claim 6, wherein the second end is sufficiently sized to not pass through an aperture formed in the cable guide.

9. The apparatus of claim 6, wherein at least a portion of the cable is resiliently coiled such that at least a portion of the cable is selectively retractable into and extendible from the cavity.

10. The apparatus of claim 2, wherein the second zipped opening comprises a pocket compartment of the luggage case.

11. The apparatus of claim 10, further comprising a fixed securing element coupled to the luggage case near the pocket compartment and operable to releasably receive a portion of the cable therethrough, and the fixed securing element includes a D-shaped ring attached to the luggage case near a terminus of an opening into the pocket compartment.

12. The apparatus of claim 1, wherein the first zipper closure mechanism includes a zipper track, at least one zipper slider and at least one zipper pull tab, the at least one zipper pull tab includes at least one aperture, and said lock device releasably engages the at least one aperture in one of the least two securing recesses.

13. The apparatus of claim 12, wherein the second zipper closure mechanism includes a zipper track, at least one zipper slider and at least one zipper pull tab, the at least one zipper pull tab of the second zipper closure mechanism includes at least one aperture, and said lock device releasably engages the at least one aperture of the second zipper closure mechanism in another of the at least two securing recesses.

14. The apparatus of claim 13, wherein the at least one zipper pull tab of the first or second zipper closure mechanisms is longer than the at least one zipper pull tab of the other of the first and second zipper closure mechanisms.

15. The apparatus of claim 1, wherein the lock device includes a housing with a length defining a middle portion and opposing end portions, the lock mechanism is positioned along the middle portion of the lock housing, and the securing recesses are positioned on respective opposing end portions of the lock housing.

16. The apparatus of claim 1, wherein the lock device is positioned proximal to both the first and second zipper closure mechanisms.

17. The apparatus of claim 16, wherein the lock device is positioned proximal to opening lines of said first and second zipper closure mechanisms.

18. The apparatus of claim 16, wherein when the first and second zipper closure mechanisms are releasably secured to the lock device, the first and second zipped openings are each in a sealed state.

19. The apparatus of claim 18, wherein access to said first and second zipped openings is hindered when the first and second zipper closure mechanisms are releasably secured to the lock device.

20. The apparatus of claim 1, wherein the first zipper closure mechanism opens and closes the first zipped opening and the second zipper closure mechanism opens and closes the second zipped opening.

* * * * *